US012504011B2

(12) United States Patent
Rosinski

(10) Patent No.: US 12,504,011 B2
(45) Date of Patent: Dec. 23, 2025

(54) ELECTRIC DUAL FLUID PUMP HAVING A SINGLE MOTOR

(71) Applicant: GHSP, Inc., Holland, MI (US)

(72) Inventor: Ryan David Rosinski, Whitehall, MI (US)

(73) Assignee: GHSP, Inc., Holland, MI (US)

( * ) Notice: Subject to any disclaimer, the term of this patent is extended or adjusted under 35 U.S.C. 154(b) by 357 days.

(21) Appl. No.: 18/344,280

(22) Filed: Jun. 29, 2023

(65) Prior Publication Data

US 2024/0011484 A1 Jan. 11, 2024

Related U.S. Application Data

(60) Provisional application No. 63/394,023, filed on Aug. 1, 2022, provisional application No. 63/358,546, filed on Jul. 6, 2022.

(51) Int. Cl.
*F04C 2/10* (2006.01)

(52) U.S. Cl.
CPC ..... *F04C 2/103* (2013.01); *F04C 2240/30* (2013.01); *F04C 2240/40* (2013.01)

(58) Field of Classification Search
CPC .. F04C 2/103; F04C 2240/30; F04C 2240/40; F04C 2/14; F04C 11/001; F04C 11/008; F04C 15/06; F04C 2/102; F04C 15/0088
USPC ..... 417/410.4, 423.5
See application file for complete search history.

(56) References Cited

U.S. PATENT DOCUMENTS 2,936,655 A * 5/1960 Peterson ..... F16H 1/2809 475/347
3,572,983 A * 3/1971 McDermott ..... F16D 3/185 418/61.3
4,171,938 A * 10/1979 Pahl ..... F01C 21/04 418/61.3
4,486,668 A * 12/1984 Asahi ..... H02K 5/10 123/198 C
4,493,623 A * 1/1985 Nelson ..... F04C 15/0061 417/372
4,762,479 A * 8/1988 Uppal ..... F04C 2/104 418/61.3
5,466,131 A * 11/1995 Altham ..... F04C 11/001 417/199.2

(Continued)

FOREIGN PATENT DOCUMENTS

WO 2016168105 A1 10/2016
WO 2018169376 A1 9/2018
WO 2022180496 A1 9/2022

*Primary Examiner* — Mark A Laurenzi
*Assistant Examiner* — Benjamin Doyle
(74) *Attorney, Agent, or Firm* — Price Heneveld LLP

(57) ABSTRACT

A fluid pump includes a housing, a motor that is disposed within a motor portion of the housing, a delivery pump element that is disposed within a delivery portion of the housing, and a return pump element that is disposed within a return portion of the housing. A drive shaft is coupled to each of the delivery pump element and the return pump element, and operation of the motor contemporaneously operates the delivery pump element and the return pump element via the drive shaft. The delivery pump element is configured to deliver fluid from a reservoir to a drive unit, and the return pump element is configured to deliver the fluid from a sump assembly of the drive unit to the reservoir.

19 Claims, 23 Drawing Sheets

(56) References Cited

U.S. PATENT DOCUMENTS

| | | | | |
|---|---|---|---|---|
| 6,672,058 | B1 * | 1/2004 | Langenfeld | B60K 17/105 180/6.3 |
| 7,726,126 | B1 * | 6/2010 | Hauser | F04B 23/06 60/486 |
| 8,597,002 | B2 * | 12/2013 | Mathers | F01C 21/0863 418/268 |
| 12,049,951 | B2 * | 7/2024 | Böhm | F01M 1/12 |
| 2003/0147765 | A1 * | 8/2003 | Schlipf | F16C 37/00 418/206.7 |
| 2008/0273990 | A1 * | 11/2008 | Pham | F04D 29/061 417/366 |
| 2014/0196447 | A1 * | 7/2014 | Takehana | F04C 11/001 60/456 |
| 2014/0274420 | A1 * | 9/2014 | Blewett | F01D 25/18 464/16 |
| 2016/0281712 | A1 * | 9/2016 | Muizelaar | F04C 2/102 |
| 2017/0058895 | A1 | 3/2017 | Schultz et al. | |
| 2019/0003477 | A1 | 1/2019 | Graves et al. | |
| 2021/0285443 | A1 * | 9/2021 | Jäggle | F04C 2/102 |
| 2023/0287812 | A1 * | 9/2023 | Peters | F16H 57/045 |
| 2023/0304572 | A1 * | 9/2023 | Vanderlip | H02K 7/116 |
| 2024/0183354 | A1 * | 6/2024 | Kalidindi | F04C 29/0007 |
| 2024/0271693 | A1 * | 8/2024 | Gassmann | F16H 57/0435 |

* cited by examiner

ELECTRIC DUAL FLUID PUMP HAVING A SINGLE MOTOR

CROSS-REFERENCE TO RELATED APPLICATION

This application claims priority to and the benefit under 35 U.S.C. § 119(e) of U.S. Provisional Patent Application No. 63/358,546 filed on Jul. 6, 2022, entitled ELECTRIC MOTOR WITH DUAL PUMP FOR PROVIDING SCAVENGE, DELIVERY AND LUBRICATING FUNCTIONS WITHIN A FLUID PUMP HAVING A SINGLE MOTOR, and U.S. Provisional Patent Application No. 63/394,023 filed Aug. 1, 2022, DUAL PUMP ELECTRIC FLUID PUMP HAVING A SINGLE MOTOR, the entire disclosures of each which are hereby incorporated herein by reference.

FIELD OF THE DISCLOSURE

The present invention generally relates to fluid pumps, and more specifically, dual-motor fluid pumps that can be used to scavenge fluid from one or more sumps to a reservoir and also deliver the fluid from the reservoir to a mechanical component.

BACKGROUND OF THE DISCLOSURE

Within mechanical assemblies, fluids are typically used for providing lubrication and cooling functions within the assembly. Fluid pumps can be used for delivering this fluid from a reservoir to a separate location to provide the desired function.

SUMMARY OF THE DISCLOSURE

According to one aspect of the present disclosure, a fluid pump includes a housing that has a motor portion, a delivery portion and a return portion. A motor is disposed within the motor portion. The motor is operably coupled to a drive shaft that extends from the motor and through the delivery portion and the return portion. A delivery pump element is disposed within the delivery portion and coupled with the drive shaft. A return pump element is disposed within the return portion of the housing and is coupled with the drive shaft, wherein operation of the motor operates the delivery pump element and the return pump element via the drive shaft. The delivery pump element is configured to deliver fluid from a reservoir to a drive unit, and the return pump element is configured to deliver the fluid from a sump assembly of the drive unit to the reservoir.

According to another aspect of the present disclosure, a fluid pump includes a housing, a motor that is disposed within a motor portion of the housing, a delivery pump element that is disposed within a delivery portion of the housing, and a return pump element that is disposed within a return portion of the housing. A drive shaft is coupled to each of the delivery pump element and the return pump element, and operation of the motor contemporaneously operates the delivery pump element and the return pump element via the drive shaft. The delivery pump element is configured to deliver fluid from a reservoir to a drive unit, and the return pump element is configured to deliver the fluid from a sump assembly of the drive unit to the reservoir.

According to yet another aspect of the present disclosure, a fluid pump includes a housing, a motor disposed within a motor portion of the housing, a delivery pump element that is disposed within a delivery portion of the housing, a return pump element that is disposed within a return portion of the housing, and a drive shaft that has a spline. The drive shaft extends from a rotor of the motor and to each of the delivery pump element and the return pump element. Operation of the motor contemporaneously operates the delivery pump element and the return pump element via the drive shaft. The delivery pump element is configured to deliver fluid from a reservoir to a drive unit. The return pump element is configured to deliver the fluid from a sump assembly of the drive unit to the reservoir. During the operation of the motor, the spline delivers a portion of the fluid into the motor portion and at least around the rotor of the motor to absorb heat from the motor and from a printed circuit board that is positioned in communication with the motor portion.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
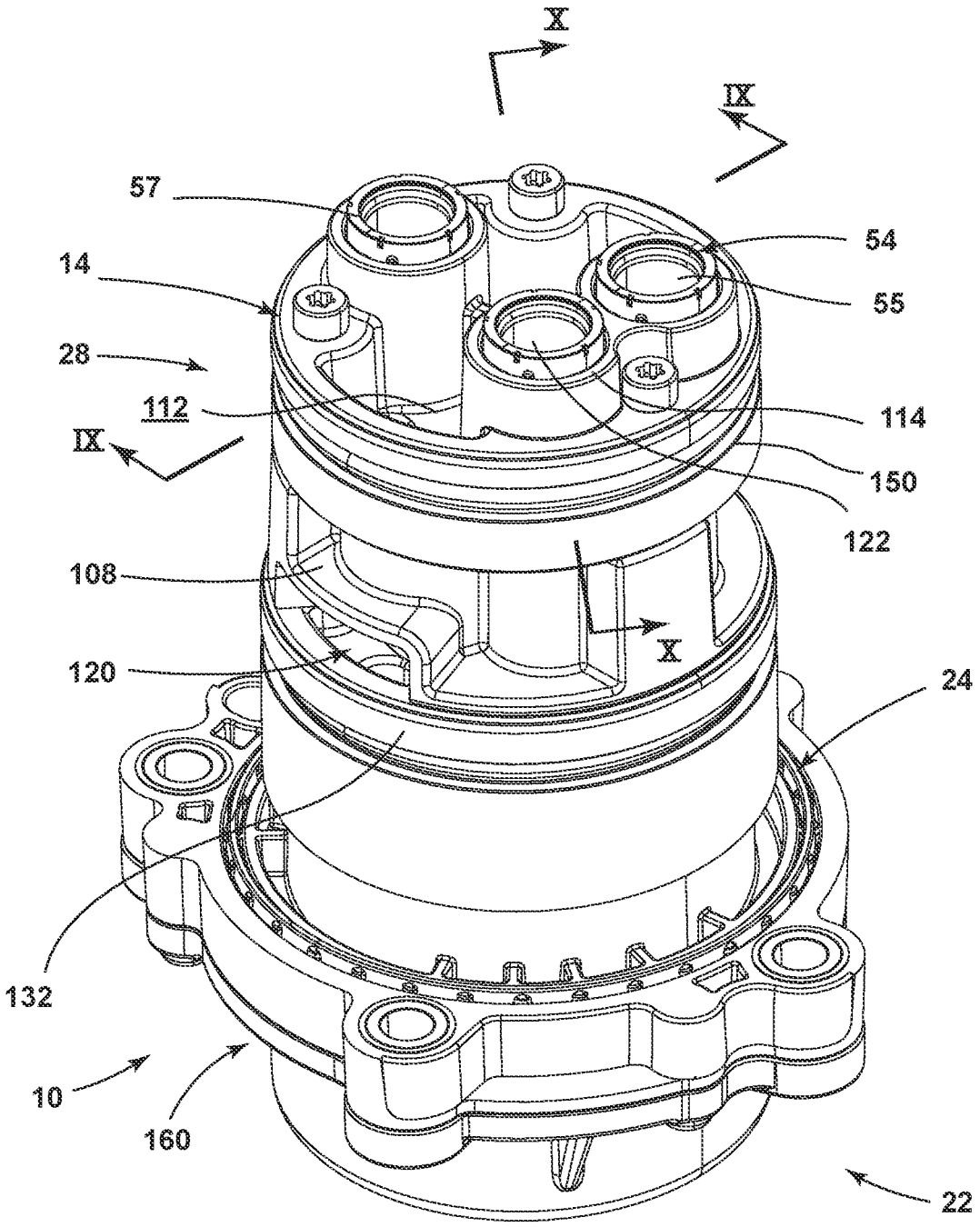
FIG. 1 is an end perspective view of an aspect of the fluid pump.
Figure 2:
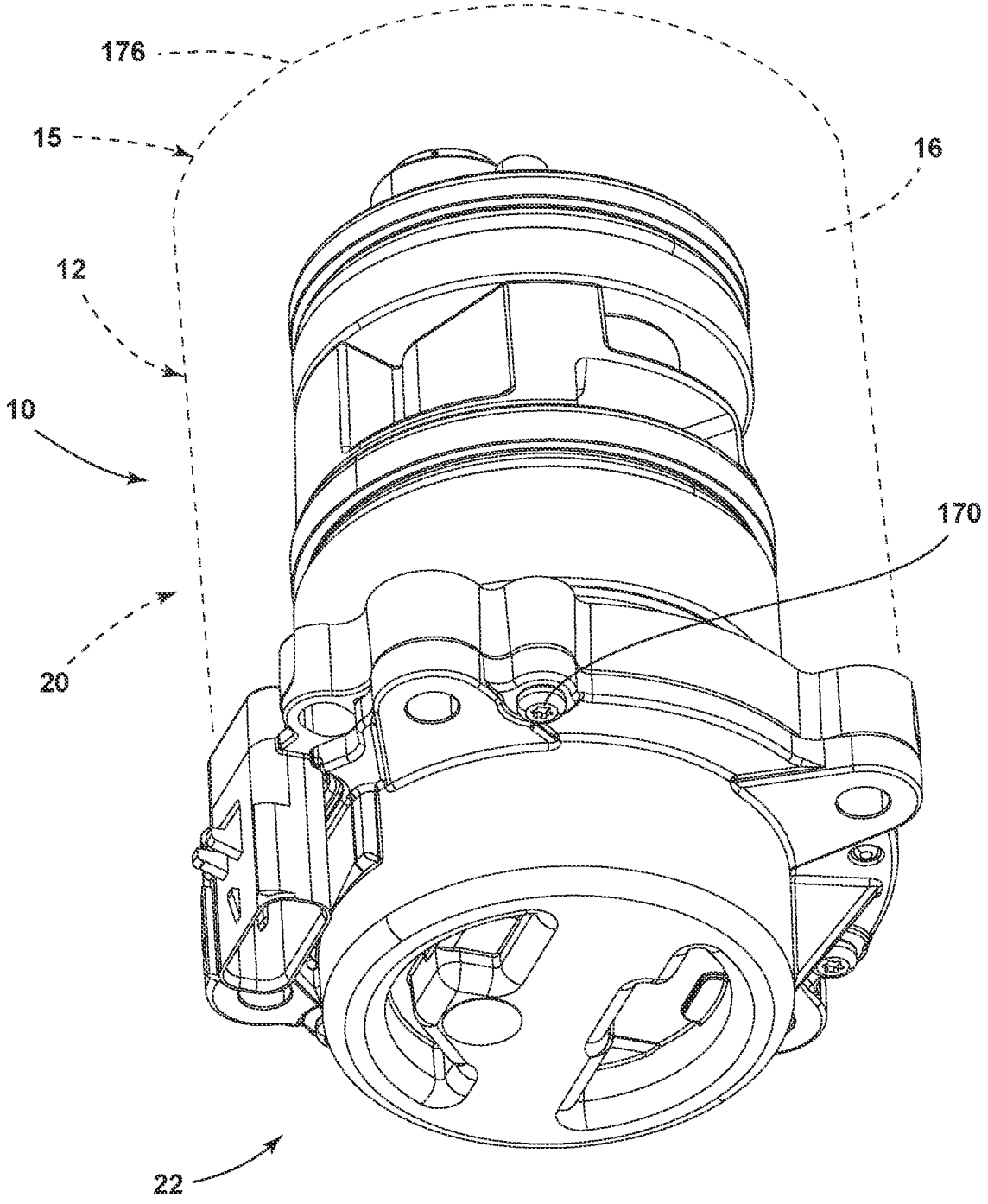
FIG. 2 is another end perspective view of the fluid pump of FIG. 1.
Figure 3:
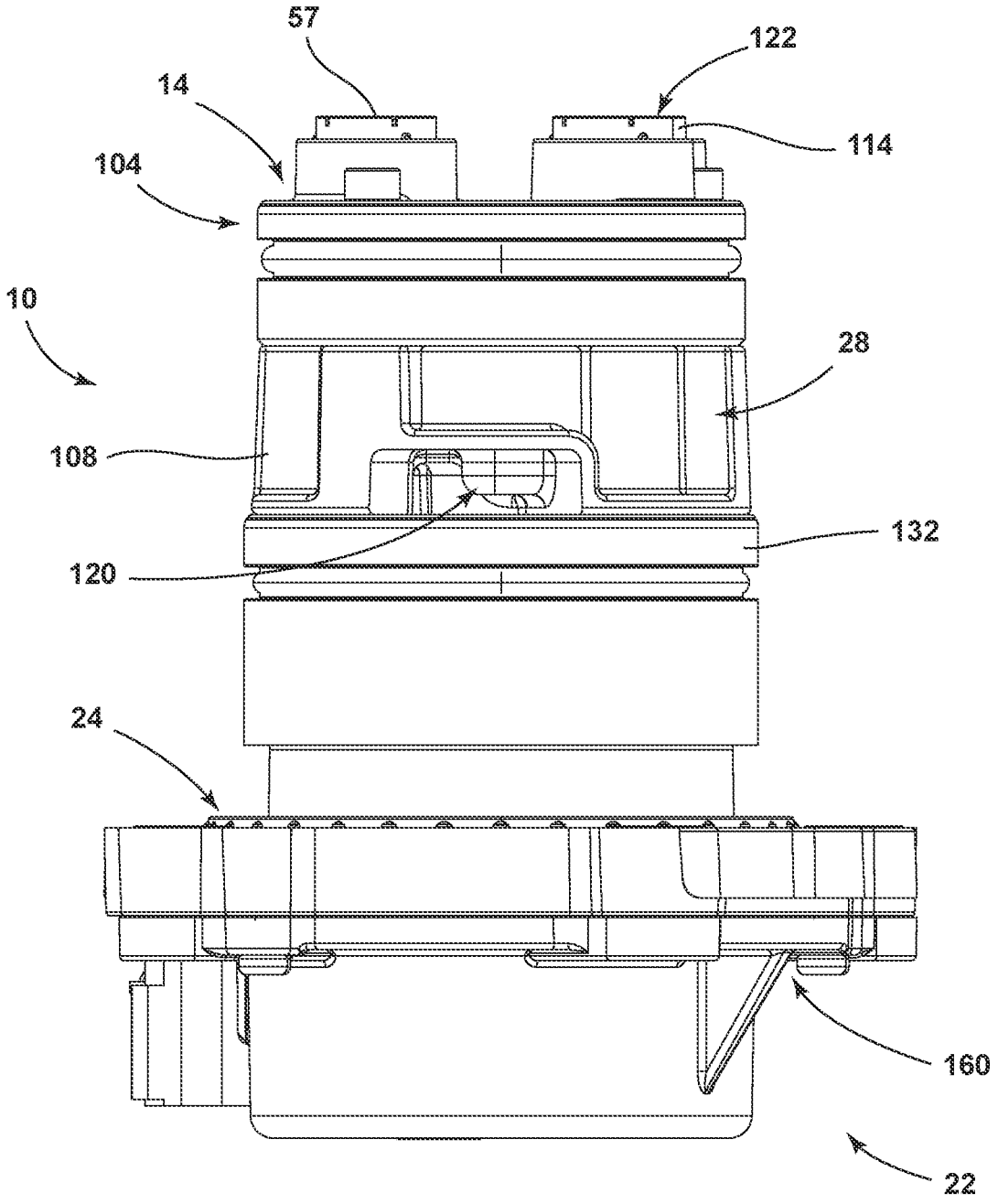
FIG. 3 is a side elevation view of the fluid pump of FIG. 1.
Figure 4:
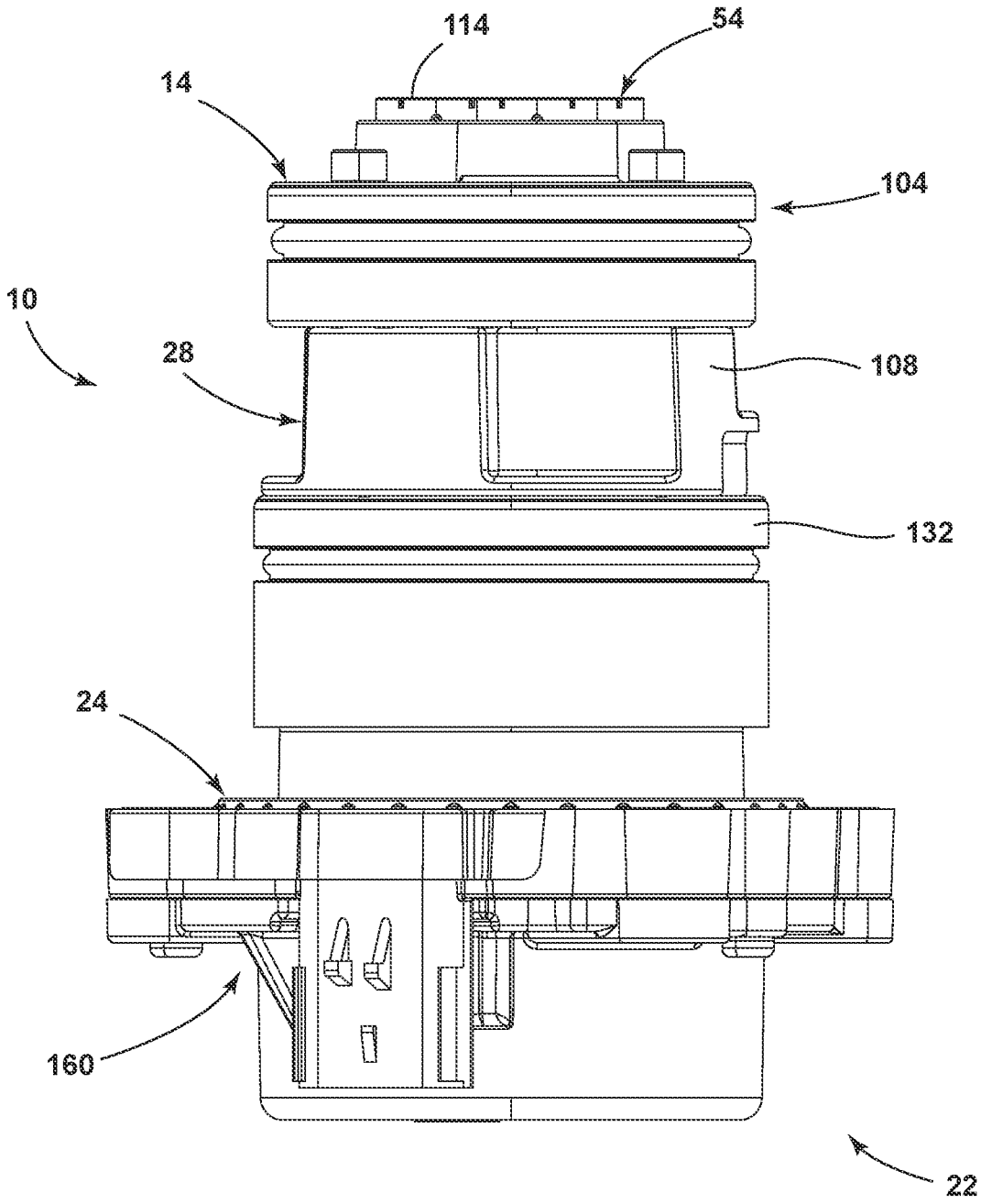
FIG. 4 is another side elevation view of the fluid pump of FIG. 1.
Figure 5:
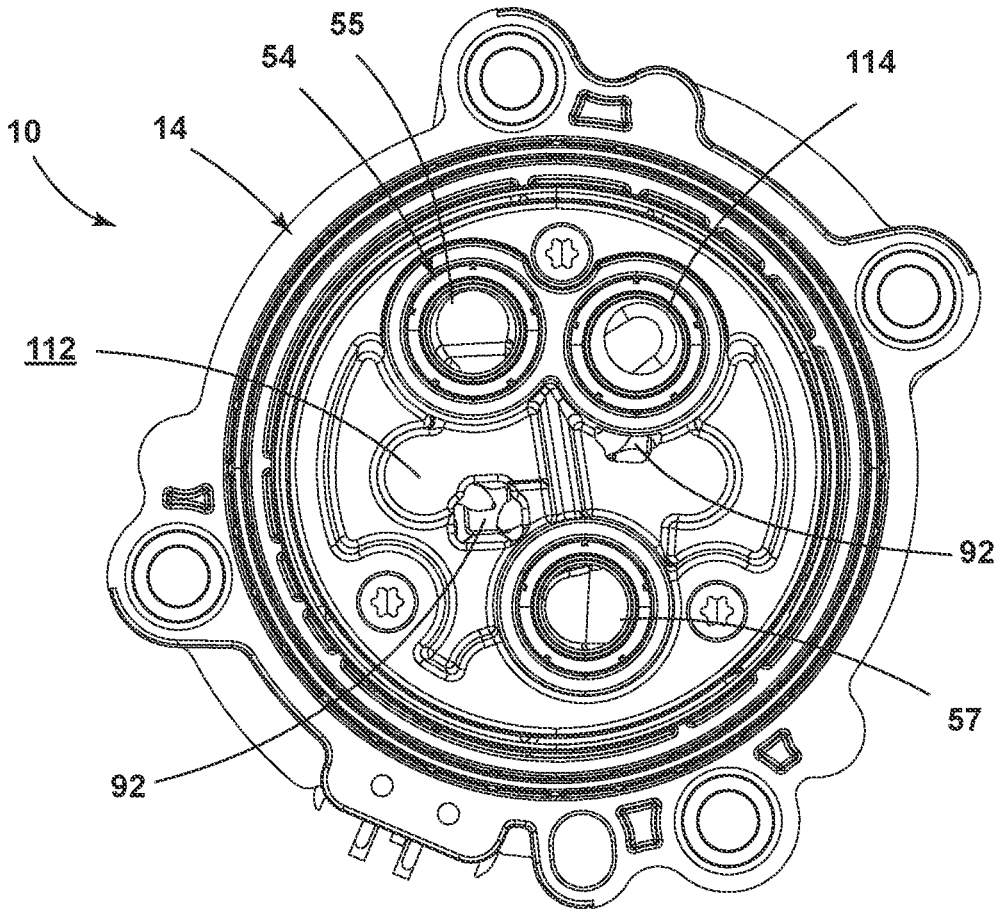
FIG. 5 is an end elevation view of the fluid pump of FIG. 1.
Figure 6:
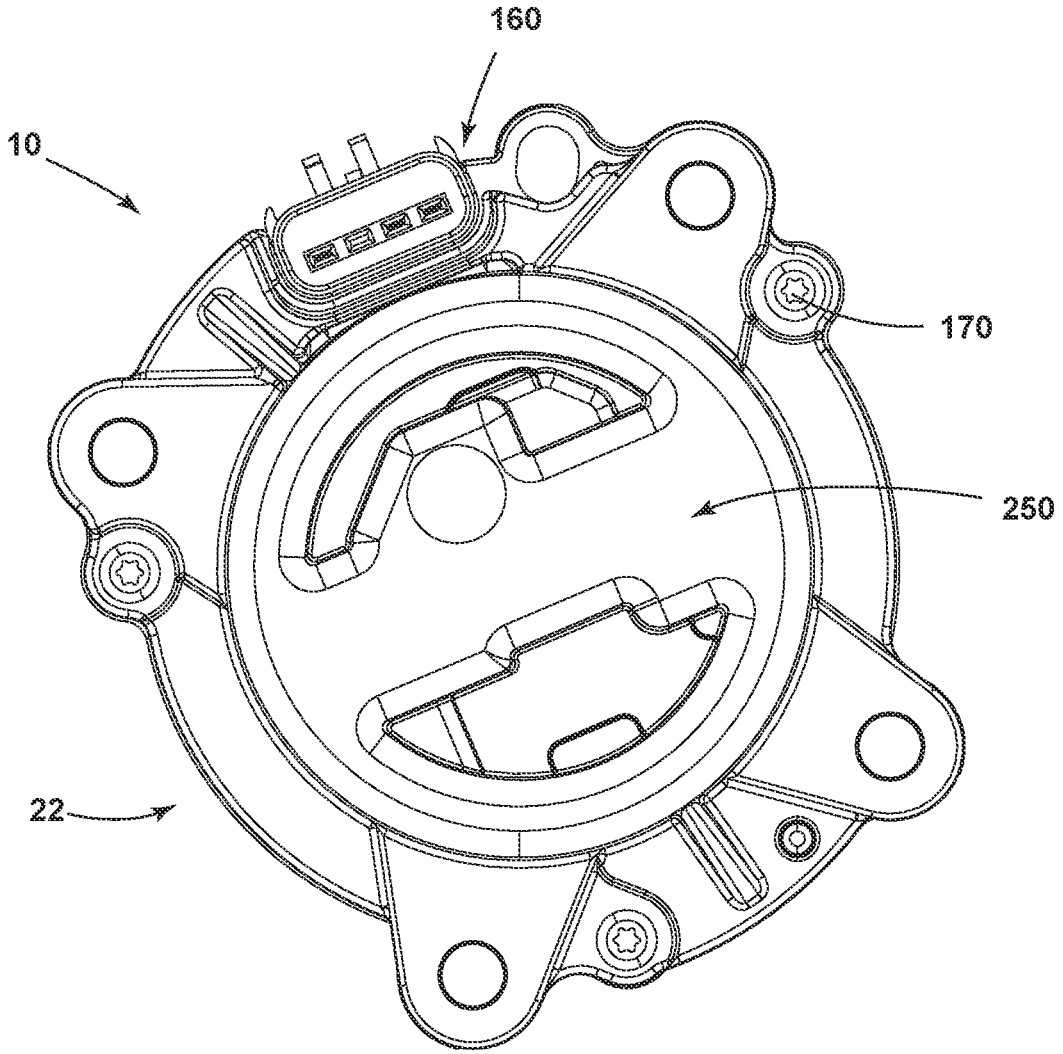
FIG. 6 is another end elevation view of the fluid pump of FIG. 1.
Figure 7:
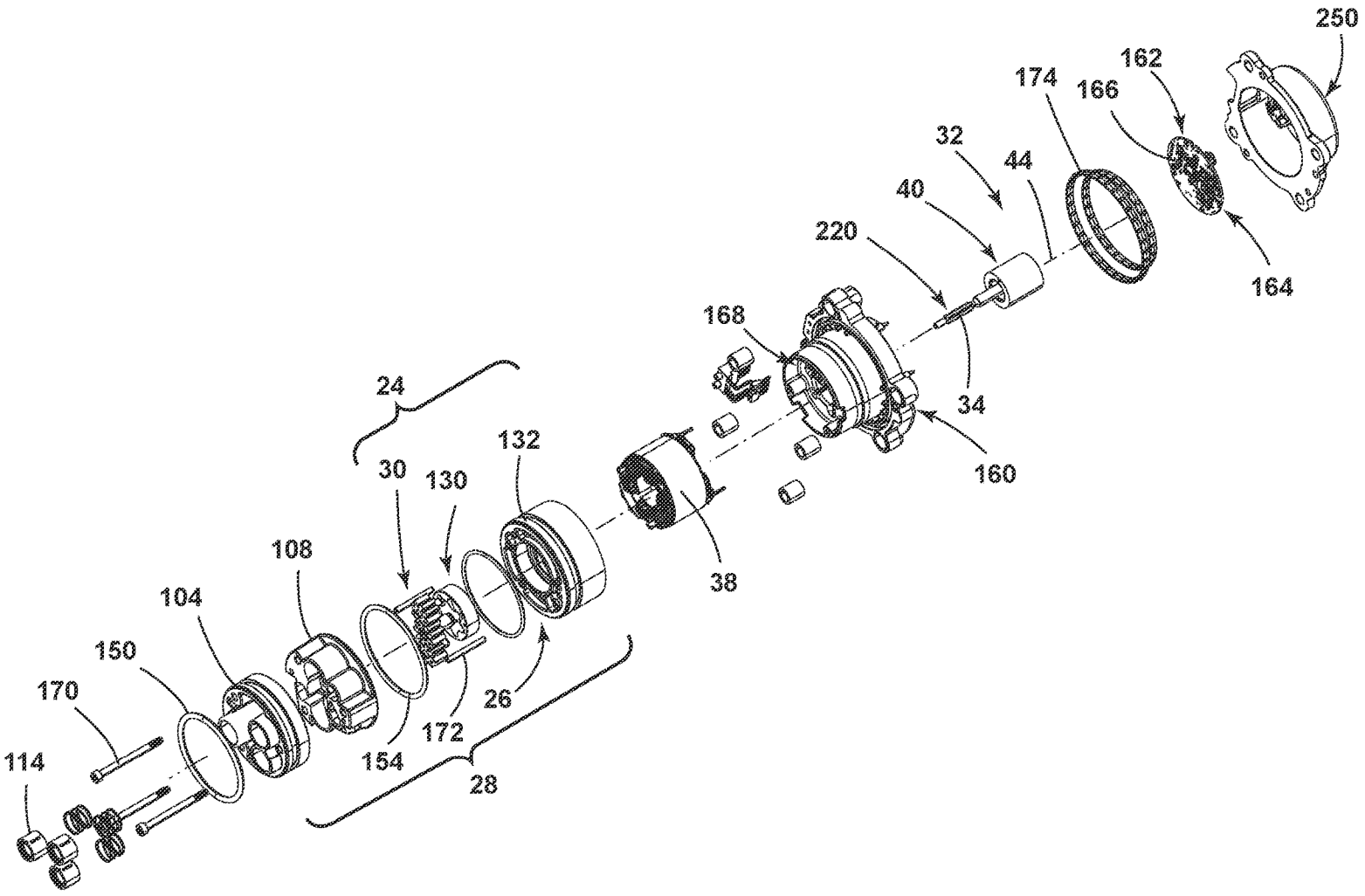
FIG. 7 is an exploded perspective view of the fluid pump of FIG. 1.
Figure 8:
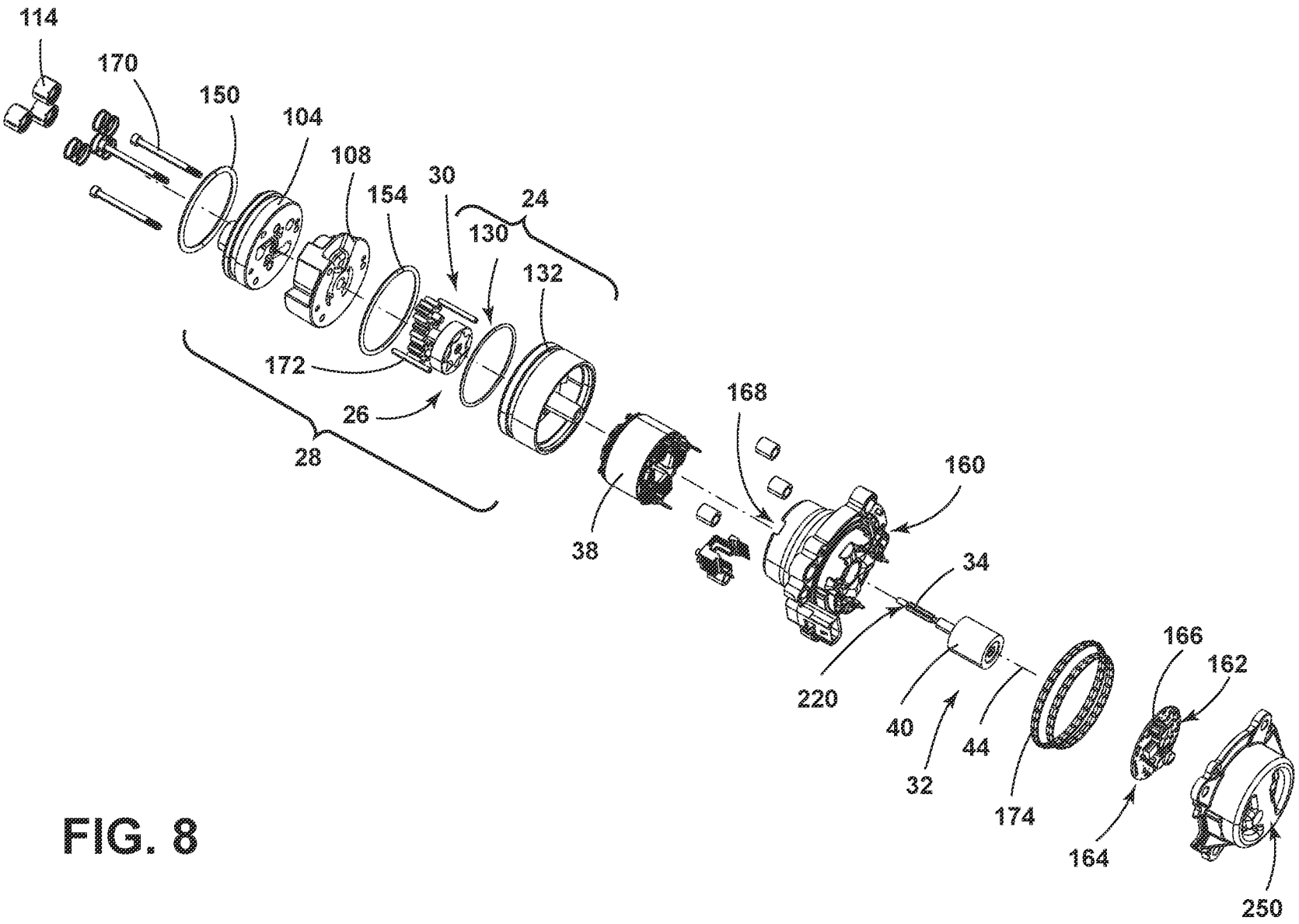
FIG. 8 is another exploded perspective view of the fluid pump of FIG. 1.
Figure 9:
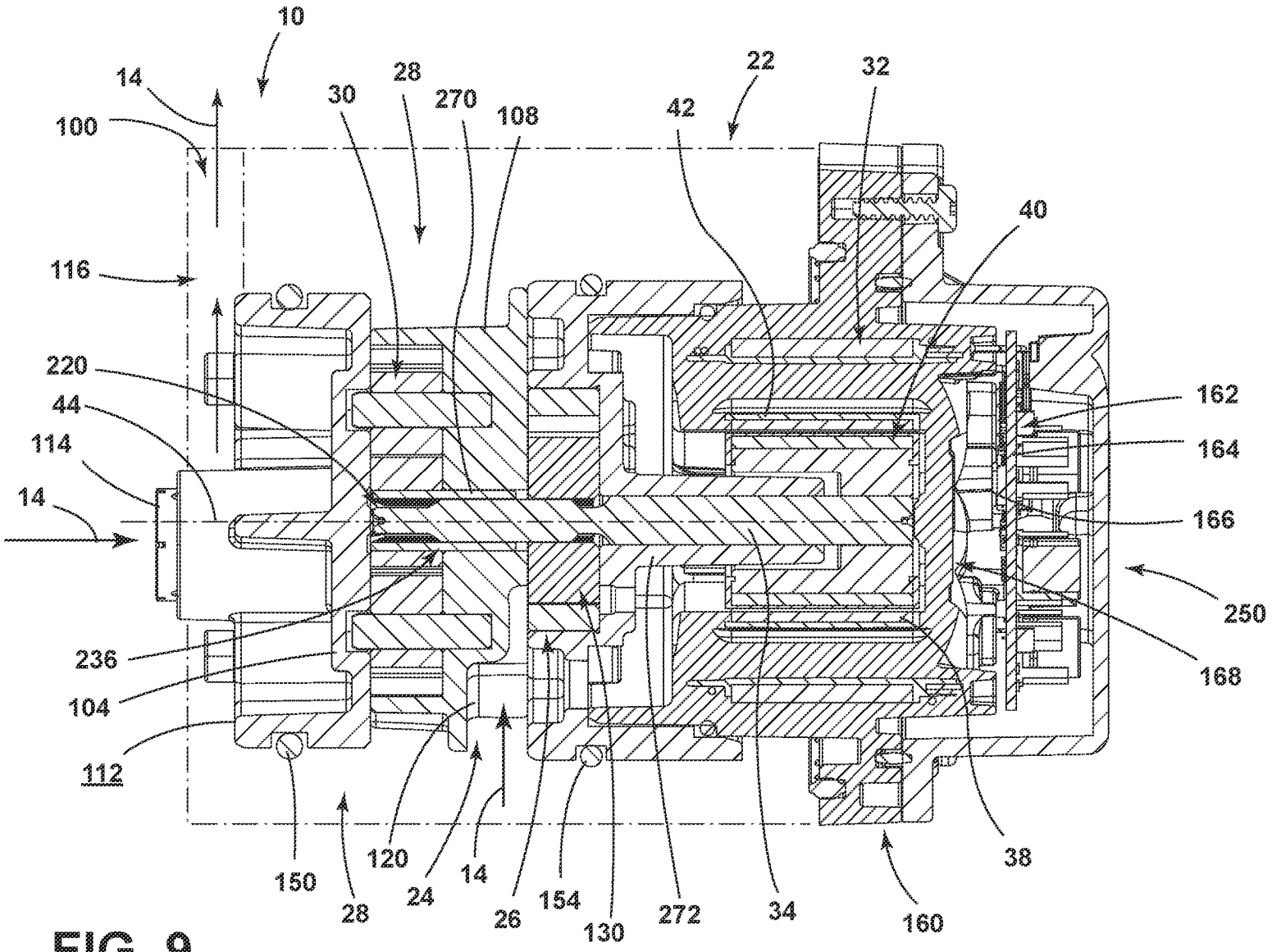
FIG. 9 is a cross-sectional view of the fluid pump of FIG. 1, taken along line IX-IX.
Figure 10:
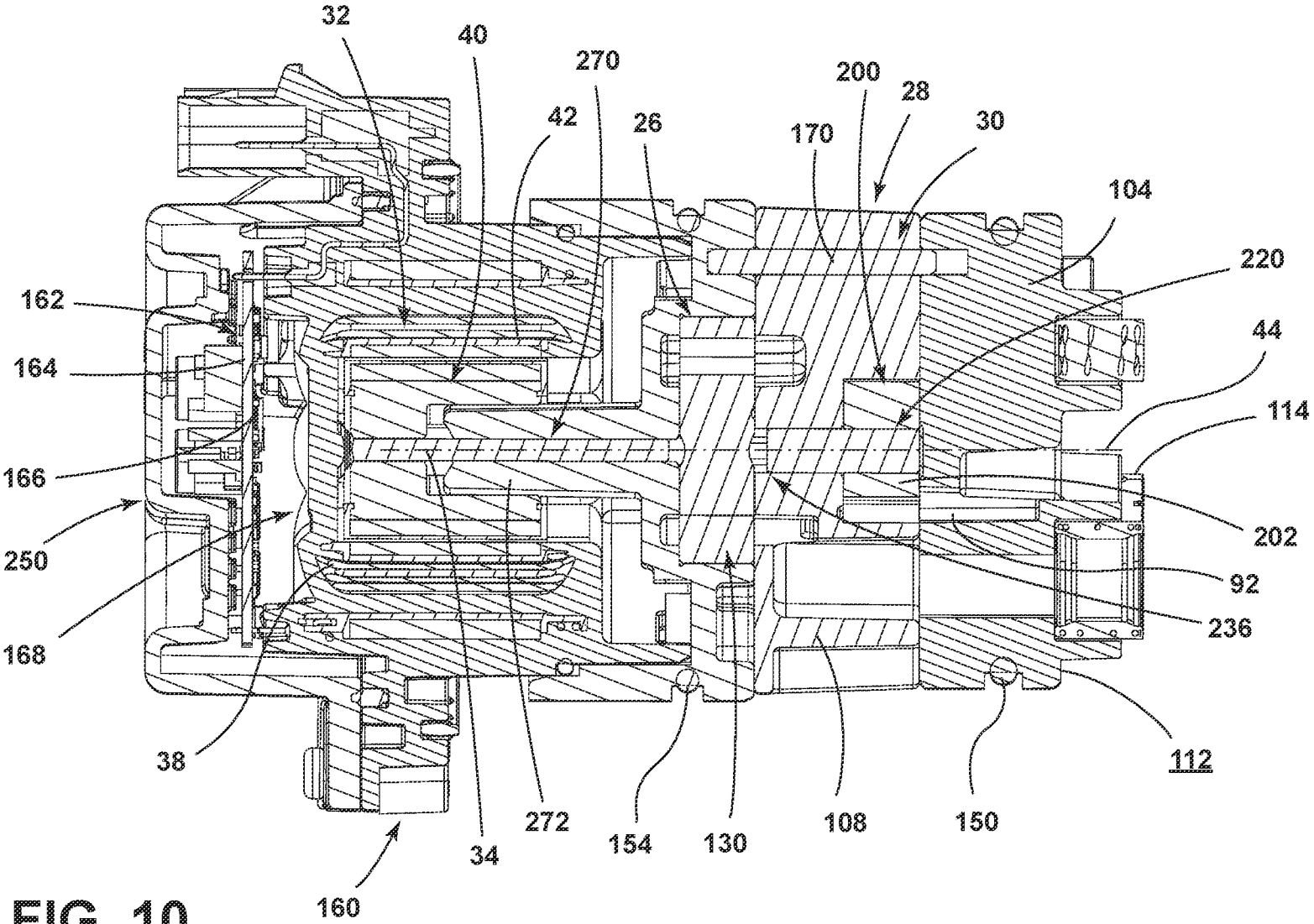
FIG. 10 is a cross-sectional view of the fluid pump of FIG. 1, taken along line X-X.
Figure 11:
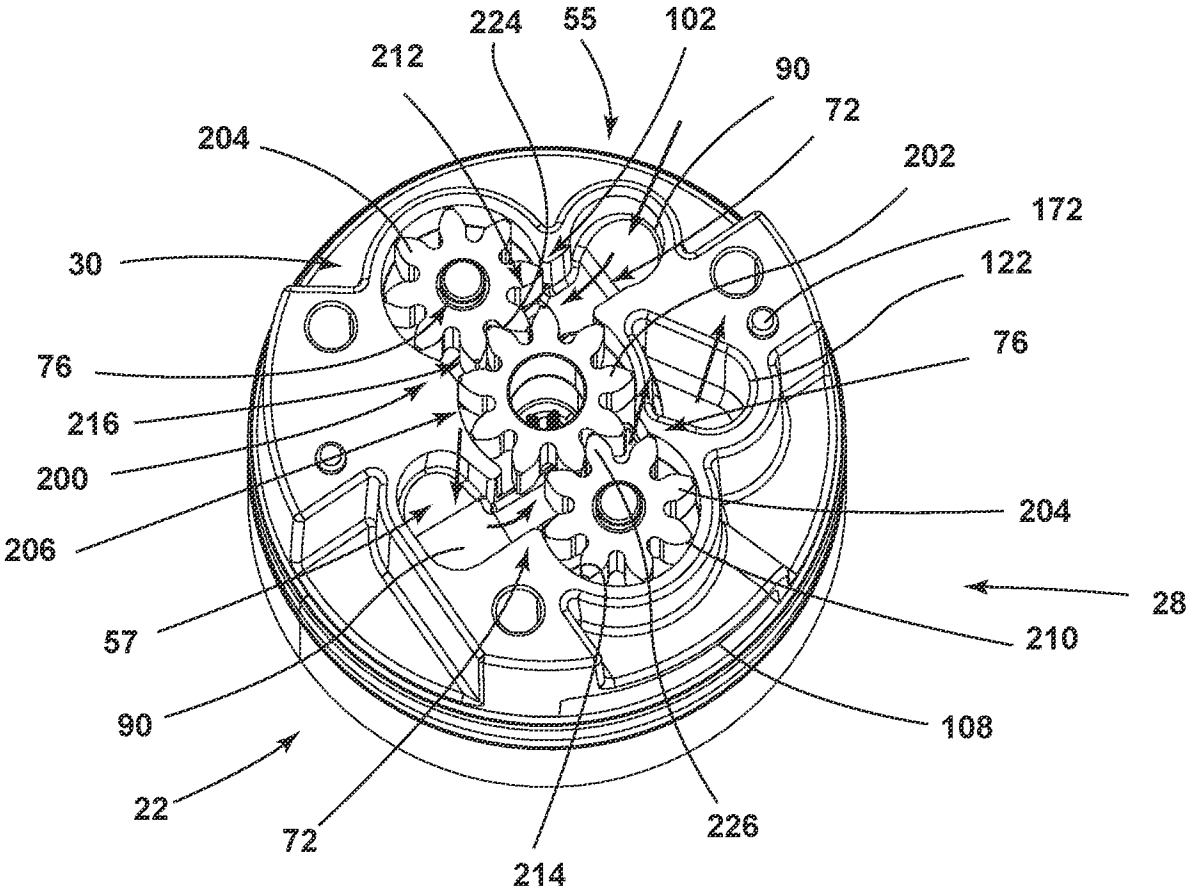
FIG. 11 is a perspective view of a porting housing that incorporates a gear pump.
Figure 12:
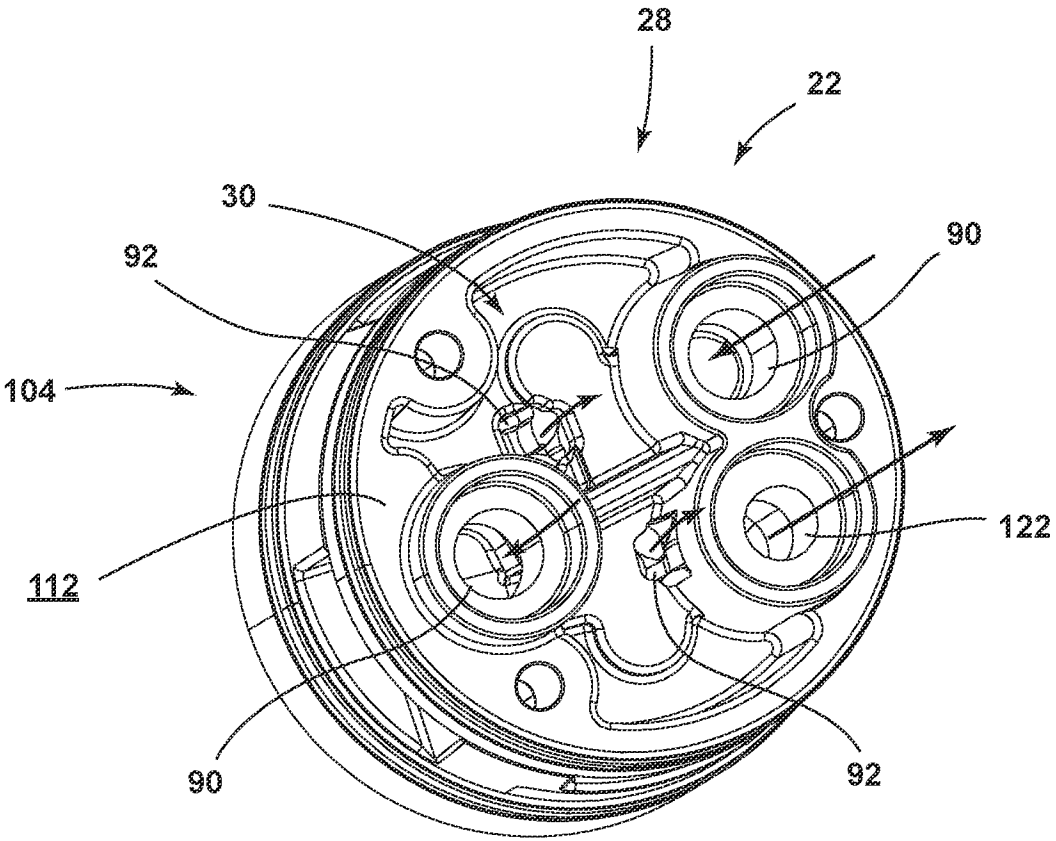
FIG. 12 is a perspective view of a pump cover that engages the gear pump housing.

Reference will now be made in detail to the present preferred embodiments of the disclosure, examples of which are illustrated in the accompanying drawings. Wherever possible, the same reference numerals will be used throughout the drawings to refer to the same or like parts. In the drawings, the depicted structural elements are not to scale and certain components are enlarged relative to the other components for purposes of emphasis and understanding.

As required, detailed embodiments of the present disclosure are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

For purposes of description herein, the terms "upper," "lower," "right," "left," "rear," "front," "vertical," "horizontal," and derivatives thereof shall relate to the concepts as oriented in FIGS. 1-26. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of method steps and apparatus components related to a fluid pump that includes a single motor for driving a delivery pump element that delivers a fluid from a reservoir to a drive unit having at least one sump, and wherein the single motor also drives a return pump element for delivering the fluid from the at least one sump to the reservoir. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

As exemplified in FIGS. 1-26, reference numeral 10 generally refers to a fluid pump that is incorporated within a mechanical assembly, such as a drive unit 12, for delivering fluid 14 from a sump assembly 15, which can include one sump 16 or a plurality of sumps 16, to a reservoir 18 and then from the reservoir 18 to the drive unit 12 that includes the sump assembly 15. The fluid pump 10 includes multiple pump elements that move the fluid 14 between the various components within a fluid circuit, such as a hydraulic system 20, for the drive unit 12. According to various aspects of the device, the fluid pump 10 includes a housing 22 that is made up of multiple components that are attached together to form the fluid pump 10. A delivery portion 24 of the fluid pump 10 includes a delivery pump element 26 that is disposed within the housing 22. A return portion 28 of the fluid pump 10 includes a return pump element 30 that is also disposed within the housing 22. A motor 32 is disposed within the housing 22 that drives the delivery pump element 26 and the return pump element 30, typically simultaneously, via a drive shaft 34. The delivery portion 24 is configured to deliver fluid 14 from the reservoir 18 to the drive unit 12. The return pump element 30 is configured to deliver the fluid 14 from at least one of the sumps 16 of the drive unit 12 to the reservoir 18, where the fluid 14 can then be delivered back to the drive unit 12 using the delivery pump element 26.

Referring to FIGS. 1-26, the drive unit 12 that is cooled or lubricated using the fluid pump 10 can be in the form of a transmission, or other similar mechanical assembly within a particular application, typically vehicular applications. The use of the fluid pump 10 having the delivery portion 24 and the return portion 28 allows the system to maintain a desirable level of the fluid 14 at the drive unit 12. Fluid 14 that may not be needed within the drive unit 12 at that time can be temporarily maintained or stored within the reservoir 18 for later recirculation throughout the hydraulic system 20. By maintaining a desirable level of fluid 14 within the drive unit 12, fluid drag within the drive unit 12 is minimized and the drive unit 12 can be of a smaller overall size or have a lower profile to accommodate the need for lesser amounts of fluid 14 within the sumps 16 of the drive unit 12.

The fluid pump 10 utilizes a single motor 32 for controlling each of the delivery pump element 26 and the return pump element 30. The delivery and return pump elements 26, 30 are integrated together to provide a compact package and weight reduction within the fluid pump 10. As discussed herein, the motor 32 is configured to simultaneously or contemporaneously operate each of the delivery and return pump elements 26, 30 via the drive shaft 34.

Referring again to FIGS. 7-26, the motor 32 that drives the delivery pump element 26 and the return pump element 30 can be an electric motor 32 having a rotor 40 that is in electromagnetic communication with a stator 38. Energizing windings 42 of the stator 38 cause the rotor 40 to rotate about a rotational axis 44. The rotor 40 is attached to the drive shaft 34 that extends through the housing 22 for the fluid pump 10. This drive shaft 34 extends through the delivery portion 24 and the return portion 28 of the housing 22. In this manner, the drive shaft 34 engages with each of the delivery pump element 26 and the return pump element 30 for operating each of these pump elements within the fluid pump 10. In addition, when the motor 32 operates, each of the delivery pump element 26 and the return pump element 30 operate simultaneously to deliver the fluid 14 through the hydraulic system 20 and between the drive unit 12, including the sump assembly 15 therefore, and the reservoir 18. The rotor 40 typically includes magnets 46 that are attached to a rotor core 48 and set within a rotor overmold 49. The drive shaft 34 is secured to the rotor core 48 via the rotor overmold 49.

Referring again to FIGS. 7-21, fluid 14 within the drive unit 12 collects within each of the sump assembly 15 for the drive unit 12. While first and second sumps 50, 52 are shown within FIGS. 15 and 16, it is contemplated that a single sump 16 or multiple sumps 16 can be included within the sump assembly 15 for a particular drive unit 12. Where multiple sumps 16 are included within the sump assembly 15, the fluid pump 10 can include a separate and dedicated return inlet 54 for each respective sump 16 of the drive unit 12. When the motor 32 for the fluid pump is activated, the return pump element 30 rotates through operation of the drive shaft 34.

As exemplified in FIGS. 1-12 and 15-17, the fluid pump 10 includes first and second return inlets 55, 57 that can be referred to as scavenge inlets. These first and second return inlets 55, 57 cooperate with the return pump element 30 to draw fluid 14 from at least one and typically both of the first and second sumps 50, 52 and into a contoured pump chamber 206 of a porting housing 108 of the fluid pump 10. The pump chamber 206 houses a gear pump 200 having a drive gear 202 that meshes with at least one idler gear 204 and typically two opposing idler gears 204. The meshing engagement between the drive gear 202 and the opposing idler gears 204 assist in drawing the fluid 14 from the first and second sumps 50, 52 and through the first and second return inlets 55, 57. During operation of the drive gear 202, the drive gear 202 meshes with the opposing idler gears 204 such that all three gears operate simultaneously to move the fluid 14 through the contoured pump chamber 206 of the porting housing 108. The return pump element 30 then operates to move the fluid 14 toward the reservoir 18 via opposing outlet ports 92 that extend from the contoured fluid cavity and through the pump cover 104. Fluid 14 is then collected within the reservoir 18 for further recirculation by the fluid pump 10, typically the delivery pump element 26, as will be described more fully below.

Referring again to FIGS. 1-12 and 15-17, the return inlets 54 extend from corresponding sumps 16 of the drive unit 12 and extend into the contoured pump chamber 206 that houses the gear pump 200 via inlet ports 90 for the return pump element 30. The corresponding outlet ports 92 extend from the pump cover 104 for delivery to the reservoir 18. The outlet ports 92 can be configured to merge together and combine within the return portion 28 of the fluid pump 10. The opposing outlet ports 92 can also merge within an area defined between the pump cover 104 and a manifold 176 that receives the fluid pump 10. Typically, a single fluid conduit extends from the fluid pump 10 for delivery to the reservoir 18.

Return channels 102 that make up the return inlets 54, the inlet ports 90, the outlet ports 92 and the return outlet 100 can be defined within the return portion 28 of the fluid pump 10. Typically, these channels are defined within the pump cover 104 and the porting housing 108. Using this configuration, the return pump element 30 is able to draw fluid 14 from either or both of the first and second sumps 50, 52 for the drive unit 12 so that the fluid 14 from these sumps 16 can be delivered to the reservoir 18 for further use. Accordingly, collection of the fluid 14 within any one sump 16 or multiple sumps 16 of the sump assembly 15 will result in fluid 14 being drawn into the return pump element 30. In this manner, whether the fluid 14 in the sump assembly 15 is contained within a single sump 16, or is divided among all of the sumps 16, the return pump element 30 can operate to deliver this fluid 14 from the sump assembly 15, through the return pump element 30 and to the reservoir 18.

Referring again to FIGS. 1-12 and 15-17, the fluid path between the pair of return inlets 54 to the single return outlet 100 can be defined between the pump cover 104 and the manifold 176 that receives the fluid pump 10. The return inlets 54 can include one gasket or a plurality of gaskets, such as spring seals 114 that span across a return flow space 116 that is defined between the end surface of the pump cover 104 and the manifold 176. The return outlet 100 can be in communication with this return flow space 116. In an exemplary operation, fluid 14 from the first and second sumps 50, 52 moves through the spring seals 114, separated from the flow space 116, then into the contoured fluid chamber 138 of the return pump element 30 via the inlet ports as described herein. The fluid 14 is then moved out from the contoured fluid cavity via the opposing outlet ports 92 and into the return flow space 116 defined between the return surface 112 of the pump cover 104 and the manifold 176. This expulsion 76 from the gear pump 200 within the pump chamber 206 pushes fluid 14 through the opposing outlet ports 92 and through the single return outlet 100 and toward the reservoir 18. Through this configuration, two return inlets 54 and the return pump element 30 provide a consistent flow of fluid 14 through the single return outlet 100 and the reservoir 18.

As described herein, in certain instances, one of the sumps 16 may be dry while the other sump 16 may include a quantity of the fluid 14. In such an instance, the return pump element 30 is able to provide sufficient fluid 14 through the return portion 28 of the fluid pump 10 for delivery of fluid 14 to the reservoir 18. As described herein, a flow of fluid 14 can occur through the drive gear 202 of the return pump element 30 and one of the idler gears 204, while little to no fluid 14 moves through the interface between the drive gear 202 and the opposing idler gear 204. As described herein, through this configuration, a consistent supply of fluid 14 can be delivered from one or both of the sumps 16 within the sump assembly 15 and to the reservoir 18 for later recirculation through the hydraulic system 20 by the delivery pump element 26.

Referring again to FIGS. 1-26, the delivery portion 24 of the fluid pump 10 includes the delivery pump element 26 that draws fluid 14 from the reservoir 18 and moves the fluid 14 through the delivery pump element 26 and towards the drive unit 12 having the sump assembly Typically, the delivery portion 24 of the fluid pump 10 will include a single delivery inlet 120 that receives fluid 14 from the reservoir 18 and a single delivery outlet 122 that delivers the fluid 14 toward the drive unit 12.

As exemplified in FIGS. 1-26, the return portion 28 of the fluid pump 10 can include two dedicated return inlets 54 that receive fluid 14 from each corresponding sump 16, respectively. The differing number of delivery inlets 120 within a delivery portion 24 and return inlets 54 within the return portion 28 is accounted for through the increased capacity of the return pump element for drawing fluid 14 from at least one of the first and second sumps 50, 52 of the sump assembly 15. The return portion 28 includes an increased capacity at the return pump element 30. In this manner, the return pump element 30 will typically deliver an amount of fluid 14 that is less than the maximum flow capacity of the return pump element 30, while also delivering sufficient fluid 14 to meet the flow requirements of the delivery pump element 26. Accordingly, under typical operating conditions, the return pump element 30 returns an amount of fluid 14 that is similar or substantially similar to the capacity of the delivery pump element 26 for the fluid pump 10. Accordingly, this increased capacity of the return pump element 30 provides for the occurrence where all of the fluid 14 in the sump assembly 15 is contained within a single sump 16 such that this fluid 14 can move from the single sump 16, through the return pump element and into the reservoir 18 for delivery to the drive unit 12 through the delivery pump element 26. Accordingly, the return pump element 30 ensures that a sufficient amount of fluid 14 is contained within the reservoir 18 for manipulation through operation of the delivery pump element 26.

By way of example, and not limitation, where a delivery pump element 26 includes a capacity of four cubic centimeters per revolution, it is contemplated that the return pump element 30 can include a capacity of eight cubic centimeters per revolution. Again, under typical operating conditions, the return pump element 30 will return the same or similar amount of fluid 14 to the reservoir 18 as that delivered by the delivery pump element 26 to the drive unit 12. As discussed herein, the increased capacity of the return fluid pump 10 accounts for situations where one of the first and second sumps 50, 52 is dry and the other of the first and second sumps 50, 52 may include a larger quantity of fluid 14. In such a condition, all of the fluid 14 returned to the reservoir 18, for a period of time, will be moved through only one of the return inlets 54, and only half of the operable pump cavities 70 of the return fluid pump 10 will produce the suction 72 and expulsion 76 of the fluid 14, until fluid 14 is allowed to collect within the other sump 16 of the first and second sumps 50, 52. Again, this configuration ensures that a consistent flow of fluid 14 is moved from one or both of the first and second sumps 50, 52 to the reservoir 18 and from the reservoir 18 to the drive unit 12 for providing adequate cooling and lubrication functions as desired.

Referring again to FIGS. 7-26, the delivery pump element 26 can be in the form of a generated rotor 130, sometimes referred to as a gerotor, that is seated within a pump body 132. The generated rotor 130 includes an inner gear 134 that rotates along the rotational axis 44 of the fluid pump 10. An outer eccentric cog 136 is placed within the pump body 132 in an offset configuration so that as the inner gear 134 rotates, a series of fluid chambers 138 are formed for delivering fluid 14 through the delivery portion 24 of the fluid pump 10. As the generated rotor 130 rotates, the various fluid chambers 138 operate to draw fluid 14, using the generated suction 72, from the reservoir 18 and then push this fluid 14, using the generated expulsion 76, towards the drive unit 12. When the fluid 14 is pushed towards the drive unit 12, the fluid 14 lubricates and cools various components and then falls toward the sump assembly 15 to be recirculated back to the fluid pump 10 using the return pump element 30 within the return portion 28 of the fluid pump 10.

Referring again to FIGS. 1-26, the porting housing 108 defines a portion of each of the delivery portion 24 of the fluid pump 10 and the return portion 28 of the fluid pump 10. Various gaskets, such as O-rings 154 and spring seals 114 are positioned at locations of the fluid pump 10 to maintain a separation of the fluid 14 that moves through the delivery portion 24 and the fluid 14 that moves through the return portion 28 of the fluid pump 10. Typically, a single gasket is able to separate the delivery inlet 120 from the delivery outlet 122 of the delivery portion 24 of the fluid pump 10. Through this configuration, the delivery inlet 120 is positioned within a sidewall of the housing 22, typically defined between a pump body 132 and a porting housing 108 of the fluid pump 10. The delivery outlet 122 of the fluid pump 10 is typically positioned within the pump cover 104. Accordingly, the return surface 112 of the pump cover 104 includes scavenge or return inlets 54 as well as scavenge or return outlets 100 of the return portion 28 of the fluid pump 10. This return surface 112 of the pump cover 104 also includes the delivery outlet 122 of the delivery portion 24 of the fluid pump 10. Through this configuration, those portions of the fluid pump 10 that either receive fluid 14 from the sump assembly 15 or deliver fluid 14 to the drive unit 12 having the sump assembly 15 are contained within the pump cover 104, and more specifically, the return surface 112 of the pump cover 104. Those portions of the fluid pump 10 that receive fluid 14 from the reservoir 18 are contained within the side of the fluid pump 10. Through this configuration, the fluid pump 10 is able to better separate those portions of the fluid 14 that are related to the delivery portion 24 from those amounts of fluid 14 that are moved by the return portion 28 of the fluid pump 10. Additionally, as described herein, the spring seals 114 that are positioned within the return inlets 54 and the delivery outlet 122 further separate the fluid 14 between the return portion 28 and the delivery portion 24 of the fluid pump Referring again to FIGS. 1-26, the fluid pump 10 includes a motor portion or a motor housing 160 that includes an overmold that defines a motor cavity 168 that surrounds the stator 38 for the motor 32, and also allows for rotational operation of the rotor 40 relative to the stator 38. The motor housing 160 can include a printed circuit board (PCB) 162 and various electrical connections that can be utilized for delivering electrical power to the motor 32 and also for communicating data to and from components of the fluid pump 10 when in operation. It is contemplated that the motor 32 can be in the form of a variable speed motor 32 such that a controller 164 can be utilized for increasing or decreasing the speed of the motor 32 depending upon the fluid flow needs of the drive unit 12. In certain conditions, such as when a motor 32 is stopped, a transmission may not be in use such that fluid 14 does not need to be circulated through the transmission. At such instances, the fluid pump 10 can be stopped temporarily. A PCB 162 within the motor housing 160 can include various sensors 166 that can monitor fluid temperature, fluid flow rates, various conditions of the fluid 14 moving through the fluid pump and other similar status information related to the fluid pump 10 and the fluid 14 moving therethrough.

As discussed herein with respect to FIGS. 1-26, the fluid pump 10 utilizes the motor 32 and a controller 164 that is included within, or in communication with, the PCB 162 to simultaneously drive each of the delivery pump element 26 and the return pump element 30. The delivery pump element 26 and the return pump element 30 are integrated together within the housing 22 for the fluid pump 10 to provide a compact package for delivering fluid 14 to and from the reservoir 18 and the drive unit 12. As discussed herein, the sump assembly 15 for the drive unit 12 can include first and second sumps 50, 52 such that a dual fill or balanced gear pump 200 is used as the return pump element 30. This configuration utilizes two separate and dedicated return inlets 54 or dedicated scavenge inlets for ensuring that fluid 14 is delivered from one or both of the first and second sumps 50, 52 and to the reservoir 18. The return portion 28 of the fluid pump 10 combines these two return inlets 54 to a single hydraulic passage that is delivered through the return outlet 100 and toward the reservoir 18. The lubricating and cooling functions of the fluid pump 10 are then provided by the delivery pump element 26 that pulls the fluid 14 from the reservoir 18 and moves this fluid 14 through various cooling and/or lubrication circuits. As discussed herein, it is typically not known which of the plurality of sumps 16 may have fluid 14 disposed therein at any particular time. The use of the return pump element 30, as a scavenge pump, having the multiple dedicated scavenge or dedicated return inlets 54, is capable of providing a sufficient flow of fluid 14 from one or both of the first and second sumps 52 into the reservoir 18. The use of the gear pump 200 as the return pump element 30 provides twice the pump displacement as the delivery pump element 26, thereby ensuring a consistent flow of fluid 14 through the hydraulic system 20.

Referring now to FIGS. 1-26, the fluid pump 10 can include the housing 22 having the motor housing 160, the delivery portion 24 and the return portion 28. The motor 32 is disposed within the motor housing 160 and is operably coupled to the drive shaft 34 that extends from the motor 32 and through the delivery portion 24 and the return portion 28. The drive shaft 34 includes a spline assembly 220 that extends along portions of the drive shaft 34 to engage both the drive gear 202 of the return pump element 30 as well as the inner gear 134 of the delivery pump element 26. Using this spline assembly 220 of the drive shaft 34, fluid 14 that is delivered into the delivery pump element 26 and the return pump element 30 is able to move along the spline assembly 220 of the drive shaft 34. This fluid 14 that is moved along the spline assembly 220 can serve to lubricate the return pump element 30, the delivery pump element 26, and the rotor 40 and drive shaft 34 of the motor 32. In this manner, the spline assembly 220 delivers the fluid 14 into the motor housing 160 and at least around a rotor 40 of the motor 32 to absorb heat 88 from the motor 32 and from the PCB 162 that is positioned in communication with the motor housing 160. Through operation of the spline assembly 220, the fluid 14 and the heat 88 are delivered away from the motor housing 160.

Referring again to FIGS. 1-26, the various components that make up the housing 22 for certain aspects of the fluid pump 10 can include, but are not limited to, the pump cover 104, the porting housing 108, the pump body 132 and the motor housing 160. These components can be attached together via pump screws 170 that extend through these components that secure them to one another. Various alignment pins 172 can be disposed within the certain components of the housing 22 for aligning certain components together. In particular, the alignment of the porting housing 108 with respect to the generated rotor 130, the pump body 132, and the pump cover 104 are used to ensure a proper flow of the fluid 14 through each of the delivery portion 24 and the return portion 28 of the fluid pump 10. In addition to the various O-rings 154 that are used to separate certain portions of the fluid 14 within a delivery portion 24 and the return portion 28, the motor housing 160 can include a case seal 174 that is used to seal the fluid pump with respect to a particular manifold 176 for the drive unit 12.

As exemplified in FIGS. 7-26, the spline assembly 220 of the drive shaft 34 includes truncated end portions 230 of the spline assembly 220 that cooperate with the gaps 232 between the inner teeth 234 of the drive gear 202 and the inner gear 134 of the return and delivery pump elements 26, 30, respectively. In this manner, the engagement between the end portions 230 and the gaps 232 define axial flow cavities 236. These axial flow cavities 236 provide for the axial movement of the fluid 14 along the drive shaft 34. Using these axial flow cavities 236, fluid 14 can move along the spline assembly 220 and along the drive shaft 34 of the fluid pump 10. Additionally, these axial flow cavities 236 are minimally sized so as to not diminish the suction 72 and expulsion 76 generated through operation of the return pump element 30 and the delivery pump element 26.

Referring now to FIGS. 1-8 and 15-26, the fluid pump 10 can include the housing 22 having the motor portion or motor housing 160, the delivery portion 24 and the return portion 28. The motor 32 is disposed within the motor housing 160 and is operably coupled to the drive shaft 34 that extends from the motor 32 and through the delivery portion 24 and the return portion 28. The delivery pump element 26 is disposed within the delivery portion 24 and is coupled with the drive shaft 34. Similarly, the return pump element 30 is disposed within the return portion 28 and is also coupled with the drive shaft 34. Operation of the motor 32 drives the delivery pump element 26 and the return pump element 30 via the drive shaft 34. The delivery portion 24 and the delivery pump element 26 are configured to deliver fluid 14 from a reservoir 18 to the drive unit 12. The return portion 28 and the return pump element 30 are configured to deliver the fluid 14 from the sump assembly 15 of the drive unit 12 and to the reservoir 18.

In certain aspects of the device, the return pump element 30 can be in the form of the gear pump 200 that includes the drive gear 202 that is coupled with the drive shaft 34. The gear pump 200 also includes the opposing idler gears 204 that meshes with the drive gear 202. Each idler gear 204 cooperates with the drive gear 202 to generate a dedicated area of suction 72 that draws fluid 14 from one sump 16 of the sump assembly 15. These opposing areas of suction 72 cooperate to deliver the fluid 14 from the first and second sumps 50, 52, respectively, and to the fluid pump 10. The engagement between the opposing idler gears 204 and the drive gear 202 also creates dedicated areas of expulsion 76 that expel the fluid 14 from each respective sump 16 of the first and second sumps 50, 52, toward the dedicated outlet ports 92 and the return outlet 100. In this manner, the dedicated areas of suction 72 and the dedicated areas of expulsion 76 operate to deliver the fluid 14 from the sump assembly 15, through the return portion 28 of the fluid pump 10 and to the reservoir 18.

As exemplified in FIGS. 7-11 and 15-17, where the return pump element 30 is a gear pump 200, the gear pump 200 includes the drive gear 202 that meshes with at least one idler gear 204 to create dedicated mesh points 216. These dedicated mesh points 216 place the return pump element 30 in communication with a respective sump 16 of the sump assembly 15. Typically, each of the dedicated mesh points 216 corresponds to a respective sump 16 of the sump assembly 15. According to the various aspects of the device, the gear pump 200 includes a plurality of mesh points 216. Each mesh point 216 of the plurality of mesh points 216 is configured to generate a suction 72 to draw the fluid 14 from the sump assembly 15 to the return pump element 30. The mesh points 216 also generate expulsion 76 to deliver the fluid from the return pump element 30 and to the reservoir 18. Additionally, each mesh point 216 of the plurality of mesh points 216 for the gear pump 200 corresponds to a respective sump 16 of the sump assembly 15. By way of example, and not limitation, the sump assembly 15 can include the first sump 50 and the second sump 52 that correspond to a first mesh point 224 of the gear pump and a second mesh point 226 of the gear pump, respectively.

Referring again to FIGS. 7-11 and 15-17, during operation of the motor 32, the drive shaft 34 operates each of the delivery pump element 26 and the return pump element 30. In the case of the gear pump 200, the drive shaft 34 rotates the drive gear 202 and the idler gear 204 within a pump chamber 206 having a contoured profile that matches the placement of the drive gear 202 and the opposing idler gears 204. As the drive gear 202 and the idler gears 204 rotate within the pump chamber 206, cogs 210 of the drive gear 202 and the idler gears 204 form a plurality of gear cavities 212 with the inside surface 214 of the pump chamber 206. These gear cavities 212 generate the dedicated areas of suction 72 and the dedicated areas of expulsion 76. In this manner, the individual gear cavities 212 deliver fluid 14 from the return inlet 54 that draws fluid 14 from the sump 16. As the drive gear 202 and the idler gear 204 rotate within the pump chamber 206, the fluid 14 within the gear cavities 212 is moved along the inside surface 214 of the pump chamber 206 and to the outlet port 92 of the return outlet 100 to be delivered to the reservoir 18.

Referring again to FIGS. 15-26, according to the various aspects of the device, the delivery inlet 120 and the delivery outlet 122 can be positioned to extend from the delivery pump element 26 and through the pump cover 104. Accordingly, the delivery inlet 120, the delivery outlet 122, as well as the return inlet 54 and the return outlet 100 can each be positioned within the return surface 112 of the pump cover 104. To account for movement of the fluid 14 by the delivery pump element 26 and the return pump element 30 through the pump cover 104, the pump chamber 206 can be positioned across the center of the pump cover 104. This central configuration of the pump chamber 206 also allows the drive gear 202 to be centrally positioned within the pump cover 104 to engage the drive shaft 34. The idler gears 204 are typically positioned in an offset orientation and to opposite sides of the pump cover 104 relative to the delivery inlet 120 and delivery outlet 122.

Referring again to FIGS. 1-26, the fluid pump 10 can include the motor portion or motor housing 160, the delivery pump element 26 and the return pump element 30. The drive shaft 34 extends from the motor 32 to each of the delivery pump element 26 and the return pump element 30. The motor 32, the drive shaft 34, the delivery pump element 26 and the return pump element 30 are all contained within the housing 22. Operation of the motor 32 is configured to simultaneously drive the delivery pump element 26 and the return pump element 30 via the drive shaft 34. The delivery pump element 26 is configured to deliver fluid 14 from the reservoir 18 and to the drive unit 12. The return pump element 30 is configured to deliver the fluid 14 from the sump assembly 15 of the drive unit 12 and to the reservoir 18 for later use. As described herein, the various configurations of the drive unit 12 and the fluid pump 10 can vary depending upon the design of the particular mechanism within which the fluid pump 10 is being positioned. Accordingly, the number of sumps 16 within the sump assembly 15 can vary, as well as the design of the return pump element 30.

Referring now to FIGS. 15-19, using the axial flow cavities 236 that are defined between the spline assembly 220 of the drive shaft 34 and the drive gear 202 and inner gear 134 of the return pump element 30 and the delivery pump element 26, respectively, fluid 14 can be moved along the drive shaft 34 and toward the PCB 162. Additionally, as the fluid 14 is moved through the spline assembly 220 and toward the PCB 162, circulation space 240 between the outer surface 242 of the rotor 40 and an inner surface 244 of the stator 38 can be used for delivering fluid 14 back toward the delivery portion 24 and the return portion 28 of the fluid pump 10. In this manner, as the fluid 14 is moved along the spline assembly 220 and toward the PCB 162, heat 88 from the motor 32 and the PCB 162 is absorbed by the fluid 14.

The fluid 14 and the now absorbed heat 88 is transferred away from the motor 32 and away from the PCB 162 through directed movement of the fluid 14. The fluid 14 and the heat 88 are then returned back toward the delivery portion 24 via the circulation space 240. The fluid 14 can then be reintegrated into the primary flow of fluid 14 through the delivery portion 24 or through the return portion 28 of the fluid pump 10.

In addition, the motor housing 160 can include certain heat rejecting mechanisms 250, such as a heat sink, heat rejecting fins, or other heat transfer portions, that can be used for emitting heat 88 that is accumulated within the PCB 162. Using the heat rejecting mechanisms 250 and the fluid 14 moving through the spline assembly 220 and the circulation space 240, the heat 88 can be extracted from the PCB 162 and moved to areas outside of the fluid pump 10. In this manner, the PCB 162 and the motor 32 for the fluid pump 10 can be maintained within a particular temperature range.

To allow for the reintegration of fluid 14 from the circulation space 240 near the PCB 162 and back into the flow of fluid 14 through the delivery portion 24 of the fluid pump 10, one or more suction ports 260 can be defined proximate the delivery inlet 120 of the fluid pump 10. Accordingly, suction 72 generated by the delivery pump element 26 not only draws fluid 14 from the reservoir 18 but also draws fluid 14 from the circulation space 240 within the motor housing 160. It is also contemplated that this fluid 14 from the motor housing 160 can be integrated into the remainder of the fluid 14 and through an inlet fluid pump 10 at other locations within the delivery portion 24 or the return portion 28 of the fluid pump 10.

In certain aspects of the device, as exemplified in FIGS. 13-16 and 21-22, the delivery pump element 26 can include the suction port 260 that accounts for a dual fill configuration. In this dual fill configuration, the delivery pump element 26 can use suction 72 to draw fluid 14 into the fluid chambers 138 from opposing sides of the generated rotor 130. Using this configuration, the suction port 260 can also provide a path through which fluid 14 from the circulation space 240 can enter back into the delivery portion 24 of the fluid pump 10.

In one aspect of the device, the fluid 14 from the motor housing 160 can be integrated into the primary flow of fluid 14 from the circulation space 240 at the delivery outlet 122 of the fluid pump 10 such that pressure generated by the delivery pump element 26 pushes fluid 14 from the delivery pump element 26 as well as fluid 14 from the motor housing 160 toward the pump outlet and also toward the drive unit 12. This configuration of the fluid pump 10 is intended to promote a continuous flow of fluid 14 through the motor housing 160 to extract heat 88 from the PCB 162 as well as the motor 32 to maintain the motor 32 and the PCB 162 at a relatively consistent temperature through operation of the fluid pump 10.

Figure 13:
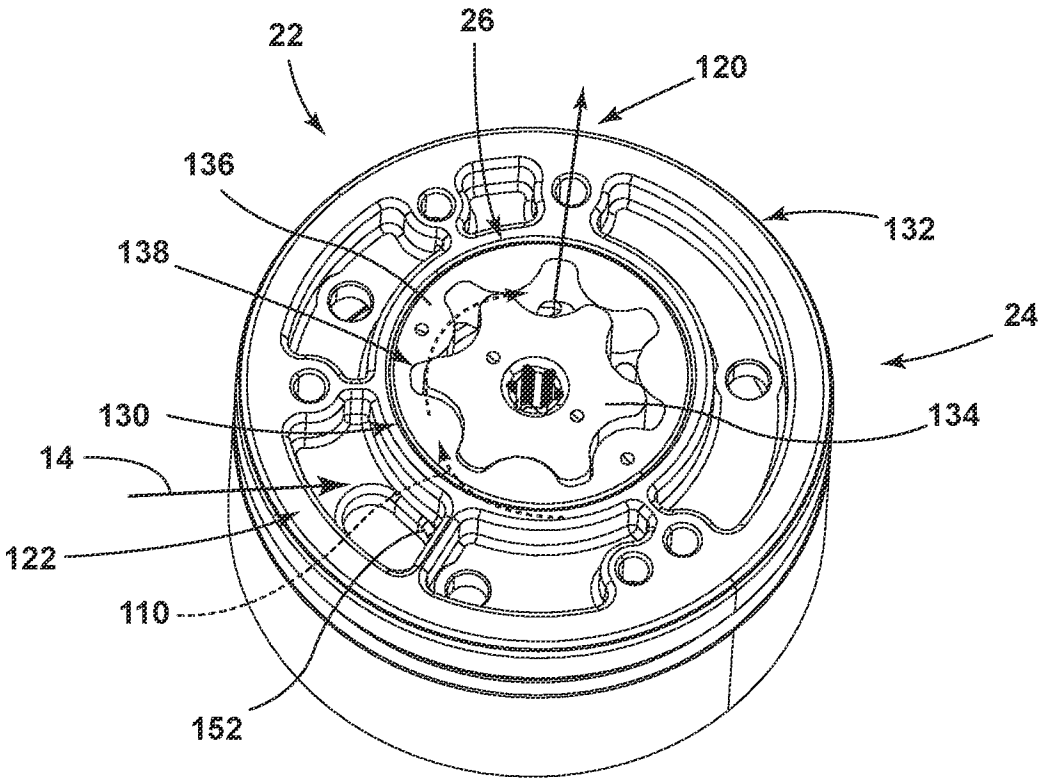
FIG. 13 is a perspective view of a pump body that receives an aspect of the delivery pump.
Figure 14:
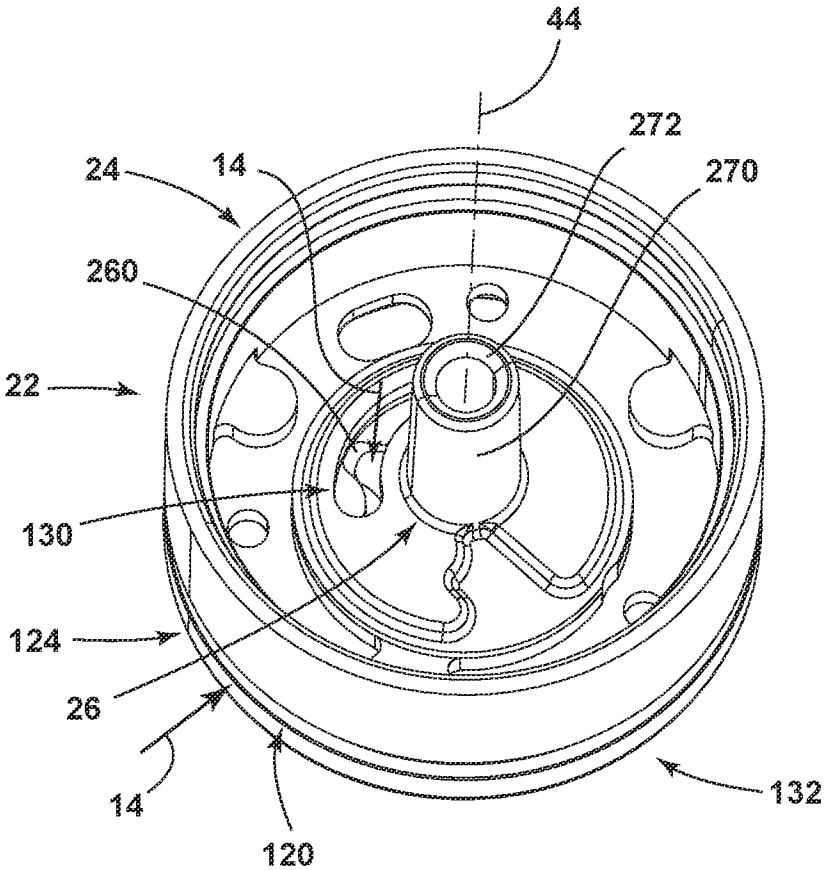
FIG. 14 is an opposing perspective view of the pump body of FIG. 13 and showing one of the bearing supports for supporting a drive shaft of the motor for the fluid pump.
Figure 15:
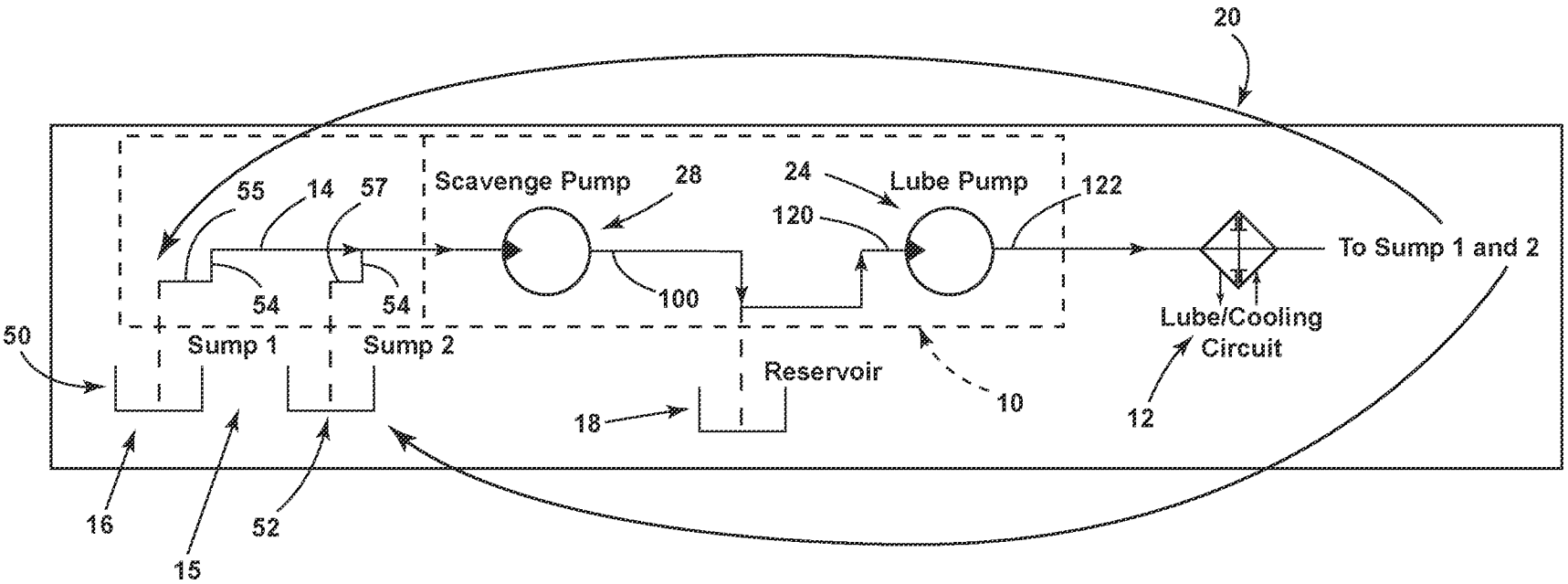
FIG. 15 is a schematic diagram illustrating a flow of fluid through a fluid path using an aspect of the fluid pump of FIG. 1.
Figure 16:
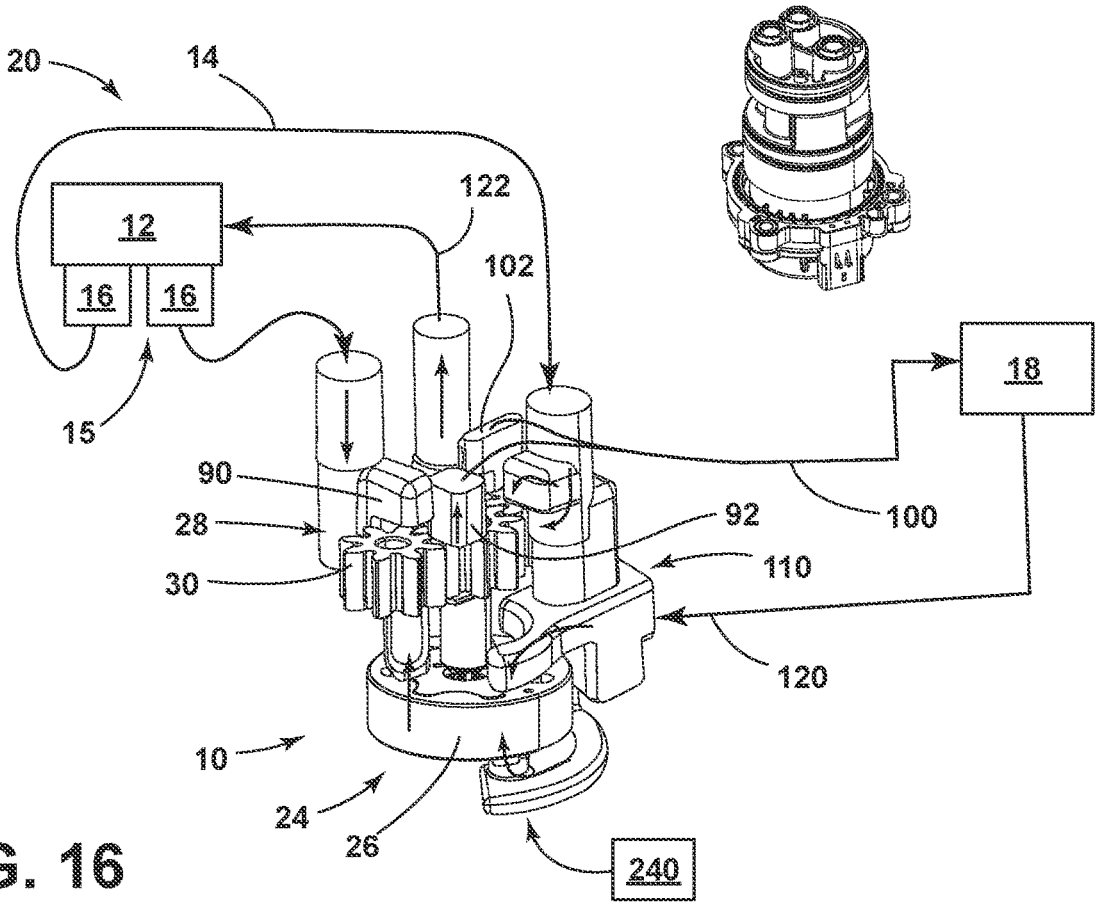
FIG. 16 is a schematic perspective view of the fluid pump illustrating movement of fluid through the delivery pump element and a return pump element of the fluid pump of FIG. 1.
Figure 17:
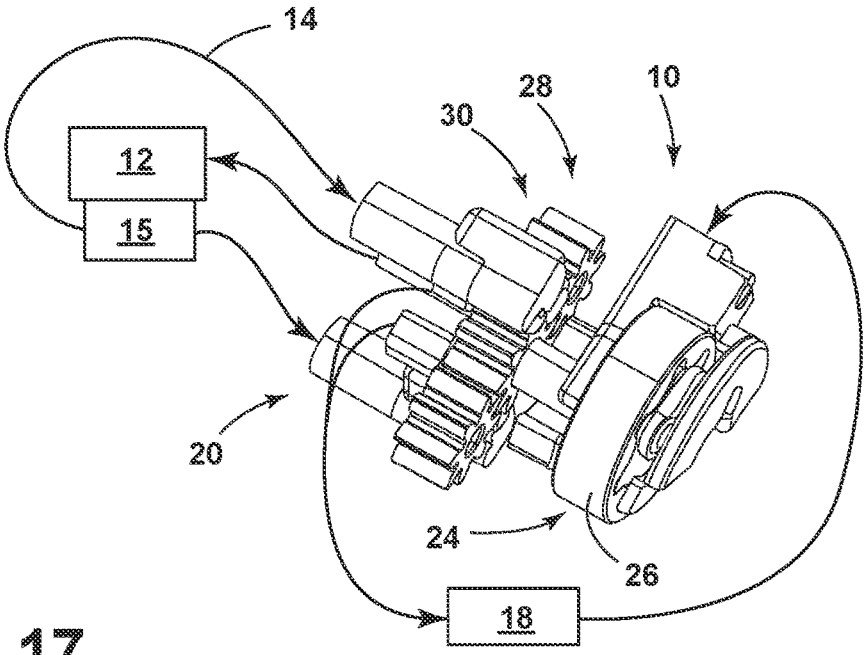
FIG. 17 is another schematic perspective view of the fluid pump illustrating movement of fluid through the delivery pump element and a return pump element of the fluid pump of FIG. 1.
Figure 18:
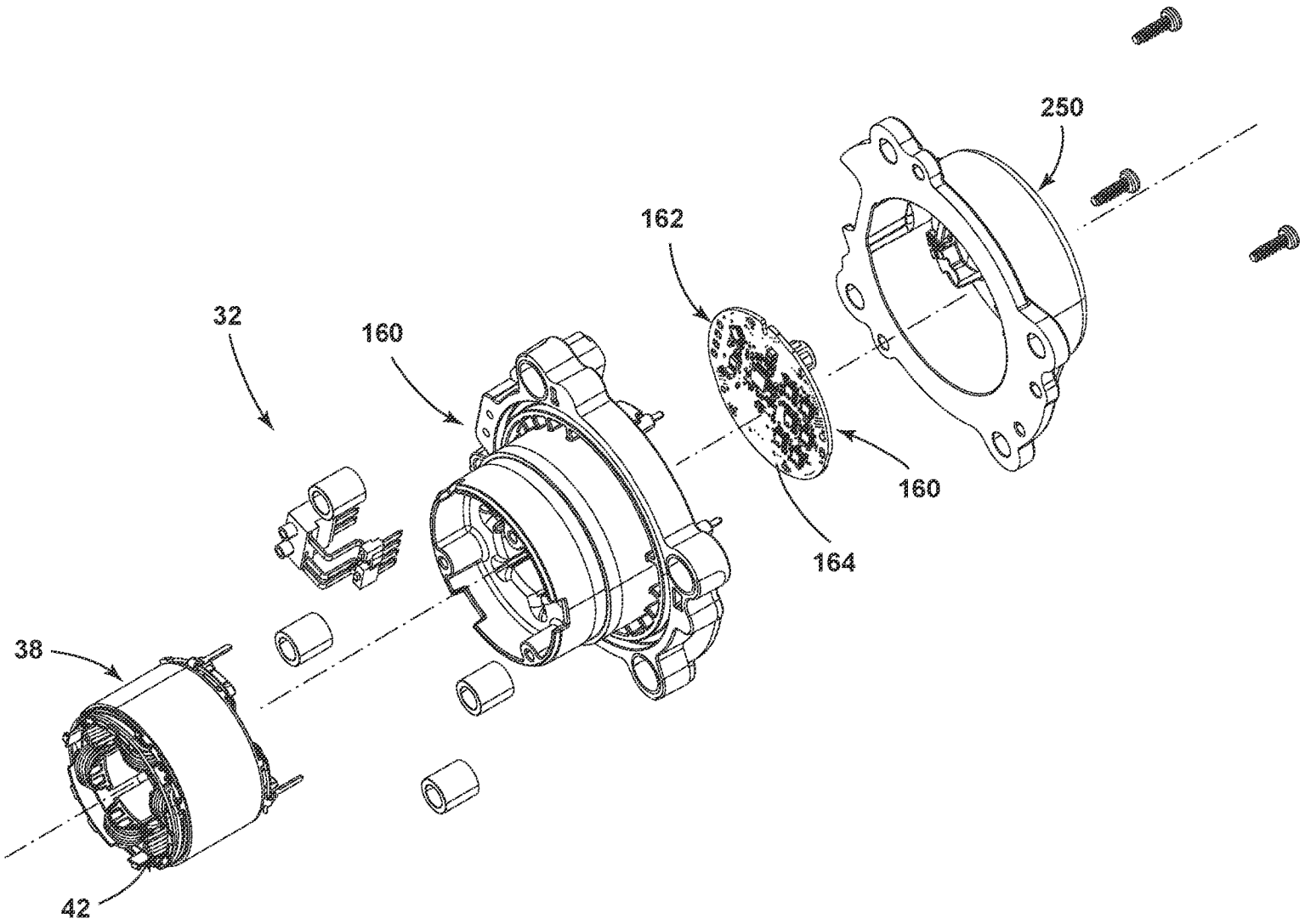
FIG. 18 is an exploded perspective view of a motor portion of the fluid pump.
Figure 19:
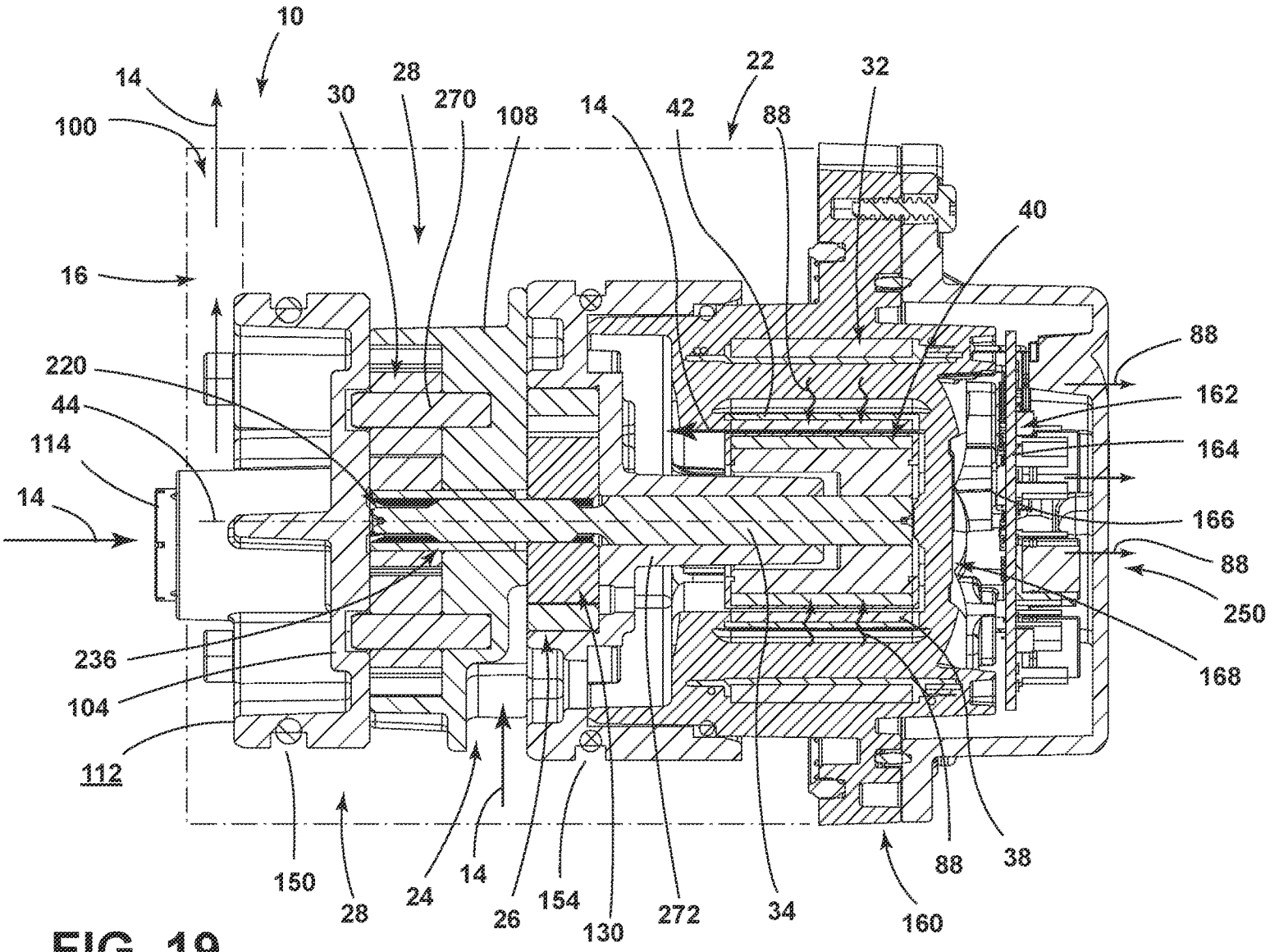
FIG. 19 is a cross-sectional view of the fluid pump of FIG. 10 and showing a heat transfer path within the fluid pump.
Figure 20:
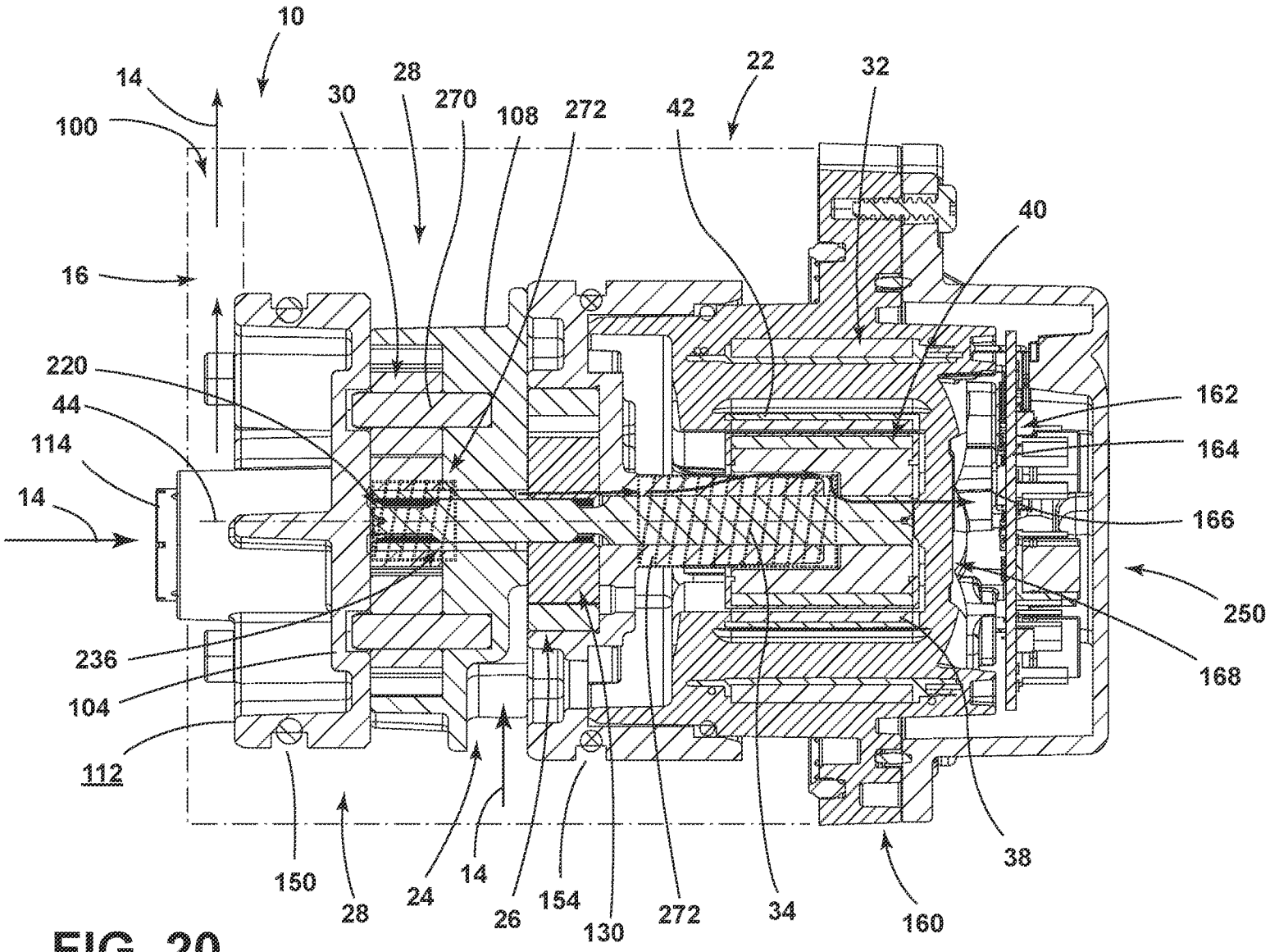
FIG. 20 is a cross-sectional view of the fluid pump of FIG. 10 and showing the configuration of the bearing supports that extend along the drive shaft and to define an axial fluid conduit along the drive shaft.
Figure 21:
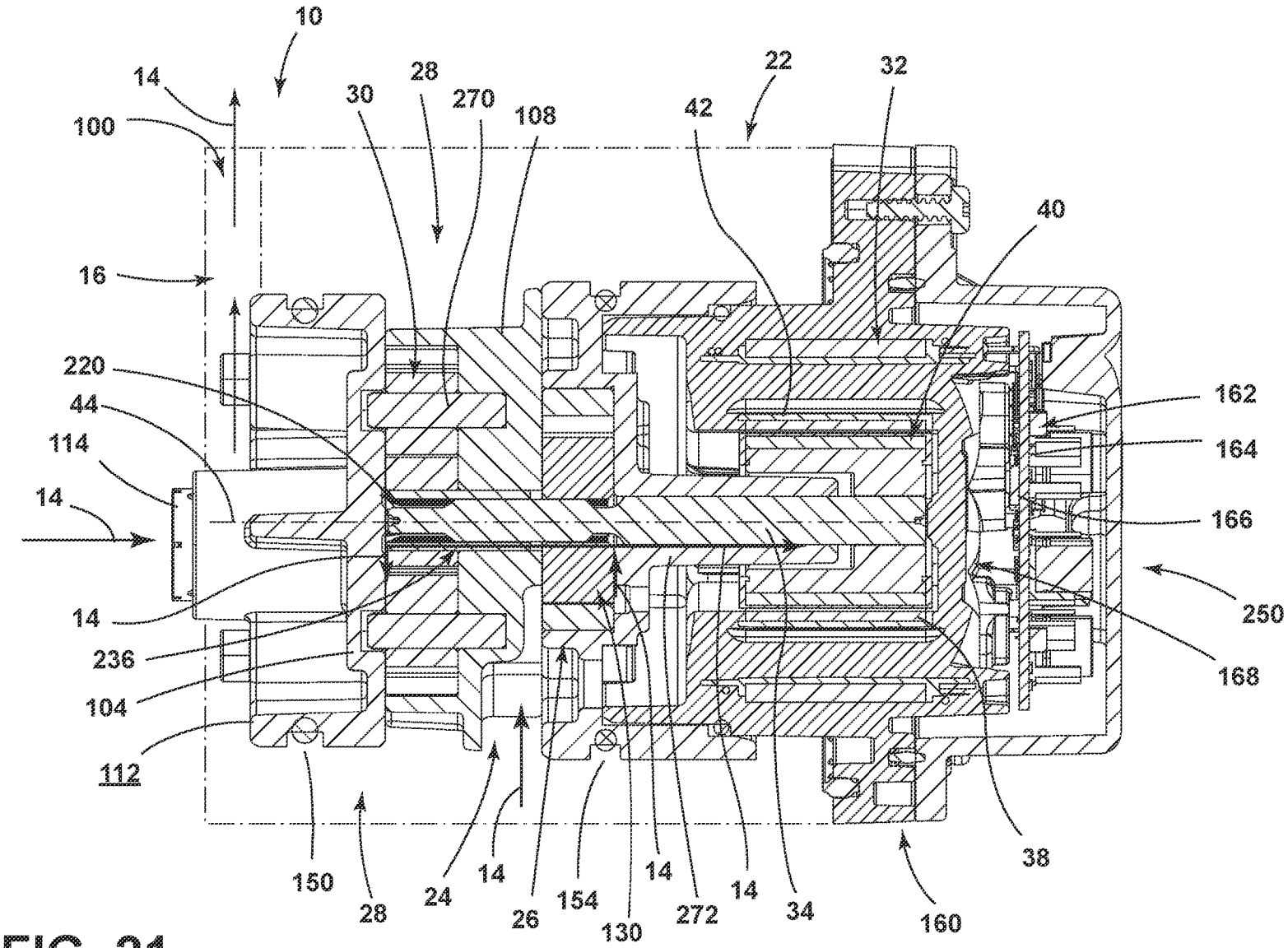
FIG. 21 is a cross-sectional view of the fluid pump of FIG. 10 and showing a configuration of an axial fluid conduit that extends along the drive shaft for lubricating the drive shaft, the delivery pump element and the return pump element.
Figure 22:
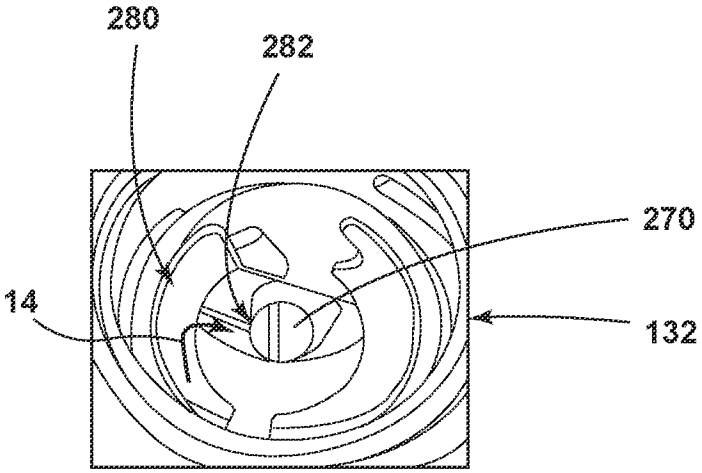
FIG. 22 is a perspective view of an aspect of a pump body for the fluid pump and having a pressure-side port for delivering fluid along the spline assembly.
Figure 24:
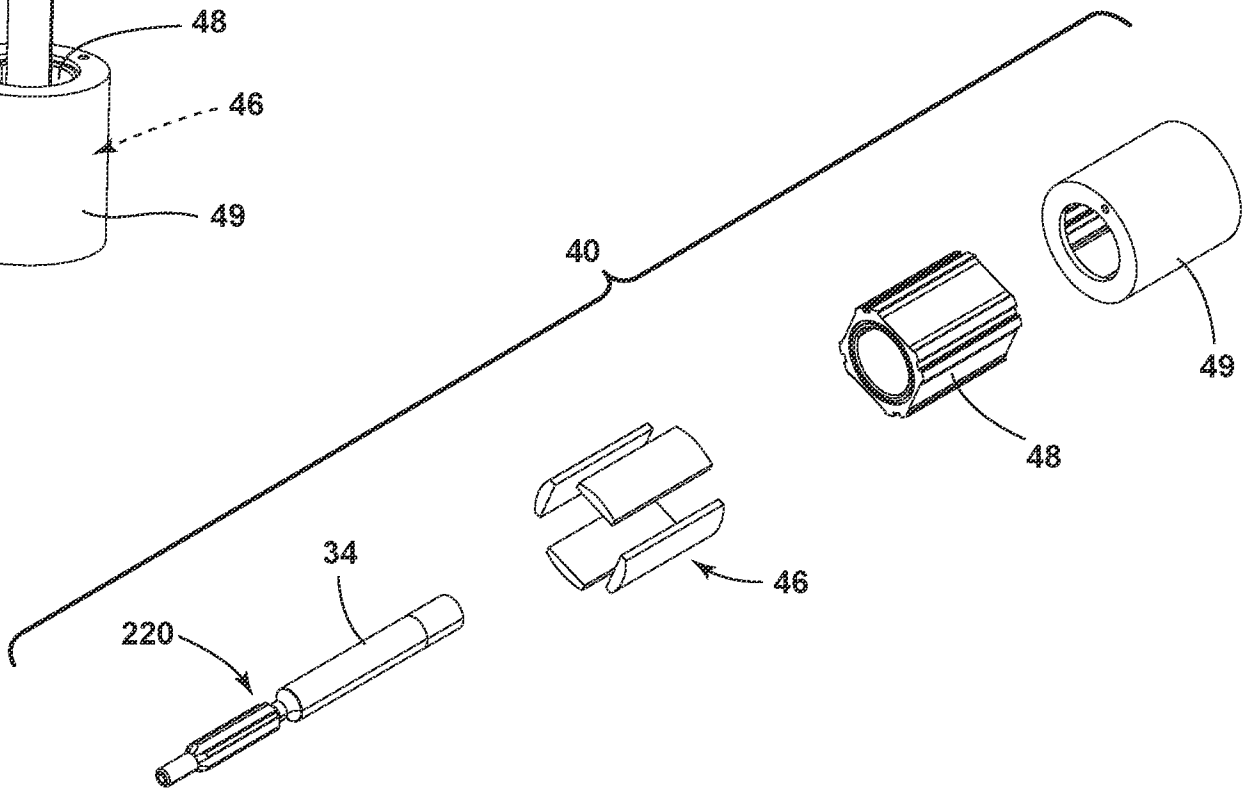
FIG. 24 is an exploded perspective view of the rotor and drive shaft of FIG. 23.
Figure 23:
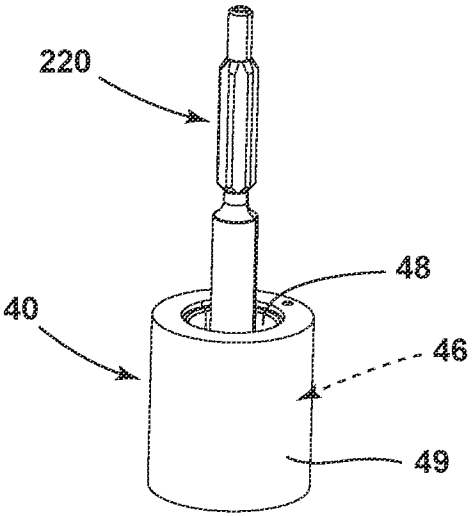
FIG. 23 is a perspective view of an aspect of a rotor and drive shaft incorporated within the fluid pump of FIG. 1
Figure 26:
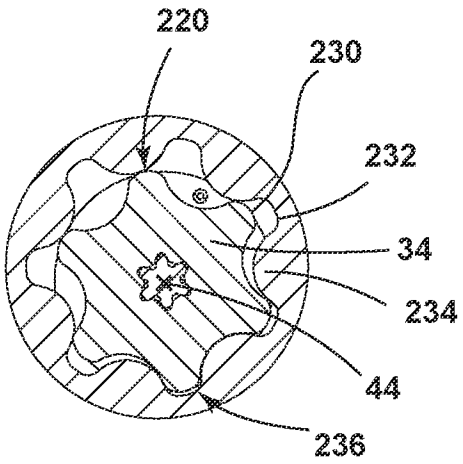
FIG. 26 is a cross-sectional view of the delivery pump element of FIG. 25 taken along line XXVI-XXVI and showing a spline of the drive shaft that defines a portion of the axial fluid conduit that allows fluid to move along the drive shaft for lubricating components of the fluid pump.
Figure 25:
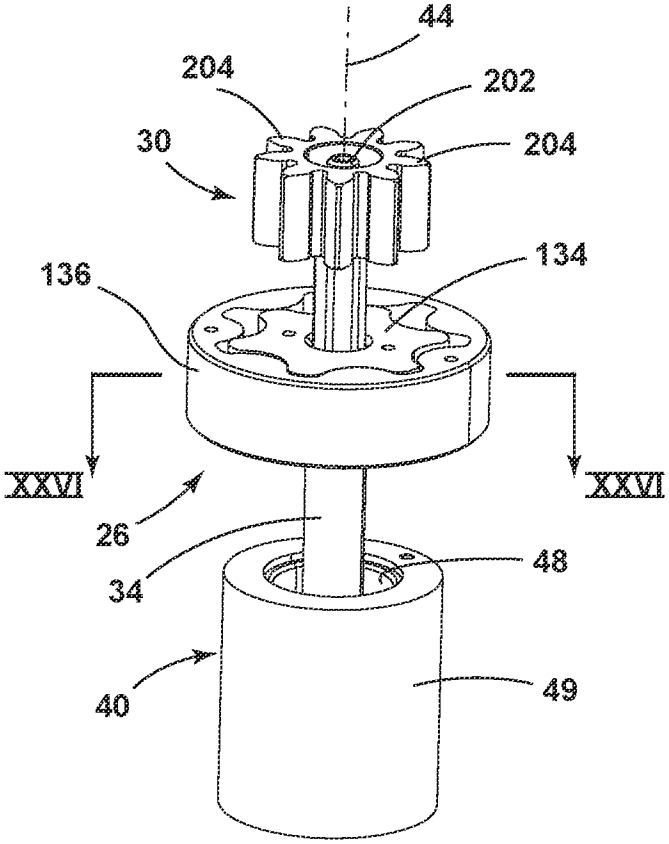
FIG. 25 is a perspective view of the rotor and drive shaft and showing interconnection with the delivery pump element and the return pump element of the fluid pump.

Referring now to FIGS. 13-14 and 20, each of the drive gear 202 for the return pump element 30 and the pump body 132 for the delivery pump element 26 can include bearing supports 270 that extend along dedicated portions of the drive shaft 34. As described herein, the engagement between the drive shaft 34 and these bearing supports 270 can at least partially define the axial flow cavities 236 that support the flow of fluid 14 along the spline assembly 220 and between the return portion 28, the delivery portion 24 and the motor housing 160. In addition, these bearing supports 270 provide axial support for the drive shaft 34 to minimize wear on the components of the motor 32 and the fluid pump 10. The bearing support 270 for the delivery pump element 26 is contained in the same pump body 132 that the delivery pump element 26 rides within. In this manner, the bearing support 270 of the pump body 132 defines a sleeve 272 through which the drive shaft 34 extends and through the inner gear 134 for the delivery pump element 26. Similarly, the bearing support 270 for the return pump element 30 is contained within the same porting housing 108 that the return pump element 30 rides within. At least a portion of the bearing support 270 is defined within a portion of the drive gear 202 for the return pump element 30, as well as the porting housing 108 that houses the return pump element 30. The porting housing 108 defines the sleeve 272 that surrounds the bearing support 270 of the drive gear 202. This configuration allows the bearing support 270 of the drive gear 202 to ride within the sleeve 272 of the porting housing 108. These bearing supports 270 provide multiple points of support for the drive shaft 34 as it rotates within the fluid pump 10 and provides multiple fluid flow functions within the fluid pump 10 as described herein.

Referring again to FIGS. 13-14 and 20, the configuration of the bearing supports 270 of the delivery pump element 26 and the return pump element 30 allows the inner gear 134 of the generated rotor 130 and the drive gear 202 of the gear pump 200 to be aligned within the fluid pump 10 and within the respective delivery and return portions 24, 28 of the housing 22. This configuration can be used to reduce the occurrence of binding of the components of the delivery and return pump elements 26, 30 and over constraining. Additionally, this configuration diminishes the need for tight tolerances within and between the components of the fluid pump 10.

Referring again to FIGS. 21-26, a portion of the pump body 132 can include a pressure side port 280 that is positioned proximate a high-pressure side of the delivery pump element 26. This pressure side port 280, during operation of the motor 32, delivers fluid 14 toward the drive shaft 34. This movement of the fluid 14 allows for movement of fluid 14 towards the drive shaft 34 and the spline assembly 220 of the drive shaft 34. The aperture through the pump body 132 that receives and supports the drive shaft 34 can include an oil feed 282 that allows for a minimal amount of fluid 14 to move from the pressure side port 280 and along the spline assembly 220 and to the motor housing 160 as well as the delivery portion 24 and return portion 28 of the fluid pump 10.

Referring again to FIGS. 15-16, the spline assembly 220 of the drive shaft 34 extends through each of the delivery pump element 26 and return pump element 30. As described herein, this spline assembly 220 is elongated to extend through both of these assemblies and also to provide movement of fluid 14 along the spline assembly 220 of the drive shaft 34. Through this spline assembly 220, the single motor 32 can rotate a single drive shaft 34 that operates multiple drive elements for accomplishing the delivery and return functions of the fluid pump 10, as described herein.

The invention disclosed herein is further summarized in the following paragraphs and is further characterized by combinations of any and all of the various aspects described therein.

According to one aspect of the present disclosure, a fluid pump includes a housing that has a motor portion, a delivery portion and a return portion. A motor is disposed within the motor portion. The motor is operably coupled to a drive shaft that extends from the motor and through the delivery portion and the return portion. A delivery pump element is disposed within the delivery portion and coupled with the drive shaft. A return pump element is disposed within the return portion of the housing and is coupled with the drive shaft, wherein operation of the motor operates the delivery pump element and the return pump element via the drive shaft. The delivery pump element is configured to deliver fluid from a reservoir to a drive unit, and the return pump element is configured to deliver the fluid from a sump assembly of the drive unit to the reservoir.

According to yet another aspect, a portion of the fluid is delivered from the delivery pump element and along a spline of the drive shaft for lubricating the delivery pump element and the return pump element.

According to yet another aspect, the operation of the motor simultaneously operates the delivery pump element and the return pump element to deliver the fluid between the reservoir, the drive unit and the sump assembly.

According to yet another aspect, the delivery pump element is a generated rotor.

According to yet another aspect, the sump assembly includes a plurality of sumps.

According to yet another aspect, the return pump element is a gear pump that includes a drive gear that meshes with at least one idler gear.

According to yet another aspect, the drive shaft extends through and operationally engages an inner gear of the generated rotor for the delivery pump element and the drive gear of the gear pump for the return pump element.

According to another aspect, the delivery portion of the housing and the return portion of the housing each define a sleeve that surrounds separate portions of the drive shaft and promotes delivery of the fluid along the drive shaft.

According to yet another aspect, the delivery portion includes a pump body that contains the delivery pump element, wherein the pump body includes a pressure side port that is positioned proximate a high-pressure side of the delivery pump element for delivering the fluid toward the drive shaft.

According to yet another aspect, during the operation of the drive shaft, the delivery pump element delivers the fluid from the pressure side port and along a spline of the drive shaft for lubricating at least the delivery pump element and the return pump element.

According to yet another aspect, the motor portion of the housing includes a heat rejecting mechanism that directs heat from a printed circuit board to an area outside of the housing.

According to yet another aspect, the spline delivers the fluid into the motor portion and at least around a rotor of the motor to absorb heat from the motor and from a printed circuit board that is positioned in communication with the motor portion, and wherein the fluid and the heat are delivered away from the motor portion.

According to yet another aspect, the gear pump includes a dedicated mesh point that places the return pump element in communication with a respective sump of the sump assembly, wherein the dedicated mesh point corresponds to the respective sump.

According to another aspect of the present disclosure, a fluid pump includes a housing, a motor that is disposed within a motor portion of the housing, a delivery pump element that is disposed within a delivery portion of the housing, and a return pump element that is disposed within a return portion of the housing. A drive shaft is coupled to each of the delivery pump element and the return pump element, and operation of the motor contemporaneously operates the delivery pump element and the return pump element via the drive shaft. The delivery pump element is configured to deliver fluid from a reservoir to a drive unit, and the return pump element is configured to deliver the fluid from a sump assembly of the drive unit to the reservoir.

According to yet another aspect, a portion of the fluid is delivered from the delivery pump element and along a spline of the drive shaft for lubricating the delivery pump element and the return pump element.

According to yet another aspect, the delivery pump element is a generated rotor.

According to yet another aspect, the sump assembly includes a plurality of sumps.

According to yet another aspect, the return pump element is a gear pump that includes a drive gear that meshes with at least one idler gear.

According to yet another aspect, the gear pump includes a plurality of mesh points, each mesh point of the plurality of mesh points is configured to generate a suction to draw the fluid from the sump assembly to the return pump element.

According to yet another aspect, each mesh point of the plurality of mesh points of the gear pump corresponds to a respective sump of the sump assembly.

According to yet another aspect, the drive unit includes a first sump and a second sump of the sump assembly that correspond to a first mesh point of the gear pump and a second mesh point of the gear pump, respectively.

According to yet another aspect, the drive shaft extends through and operationally engages an inner gear of a generated rotor for the delivery pump element and the drive gear of the gear pump for the return pump element.

According to yet another aspect, the delivery portion of the housing and the return portion of the housing each define a sleeve that surrounds separate portions of the drive shaft and promotes delivery of the fluid along the drive shaft.

According to yet another aspect, the delivery portion includes a pump body that contains the delivery pump element, wherein the pump body includes a pressure side port that is positioned proximate a high-pressure side of the delivery pump element for delivering the fluid toward the drive shaft.

According to yet another aspect, during the operation of the drive shaft, the delivery pump element delivers the fluid from the pressure side port and along the spline of the drive shaft for lubricating at least the delivery pump element and the return pump element.

According to yet another aspect, the motor portion of the housing includes a heat rejecting mechanism that directs heat from a printed circuit board to an area outside of the housing.

According to yet another aspect, the spline delivers the fluid into the motor portion and at least around a generated rotor of the motor to absorb heat from the motor and from a printed circuit board that is positioned in communication with the motor portion, and wherein the fluid and the heat are delivered away from the motor portion.

According to yet another aspect, the gear pump includes a dedicated mesh point that places the return pump element in communication with a respective sump of the sump assembly, wherein the dedicated mesh point corresponds to the respective sump that corresponds between the respective sump of the sump assembly.

According to yet another aspect, the fluid in the delivery portion of the housing is maintained separate from the fluid in the return portion of the housing.

According to yet another aspect of the present disclosure, a fluid pump includes a housing, a motor disposed within a motor portion of the housing, a delivery pump element that is disposed within a delivery portion of the housing, a return pump element that is disposed within a return portion of the housing, and a drive shaft that has a spline. The drive shaft extends from a rotor of the motor and to each of the delivery pump element and the return pump element. Operation of the motor contemporaneously operates the delivery pump element and the return pump element via the drive shaft. The delivery pump element is configured to deliver fluid from a reservoir to a drive unit. The return pump element is configured to deliver the fluid from a sump assembly of the drive unit to the reservoir. During the operation of the motor, the spline delivers a portion of the fluid into the motor portion and at least around the rotor of the motor to absorb heat from the motor and from a printed circuit board that is positioned in communication with the motor portion.

According to yet another aspect, the operation of the delivery pump element delivers the portion of the fluid and the collected heat away from the motor portion and through the delivery portion of the housing.

According to yet another aspect, the spline also delivers the portion of the fluid for lubricating the delivery pump element and the return pump element.

According to yet another aspect, the delivery pump element is a generated rotor.

According to yet another aspect, the sump assembly includes a plurality of sumps.

According to yet another aspect, the return pump element is a gear pump that includes a drive gear that meshes with at least one idler gear.

According to yet another aspect, the gear pump includes a plurality of mesh points, each mesh point of the plurality of mesh points is configured to generate a suction to draw fluid from the sump assembly to the return pump element.

According to yet another aspect, each mesh point of the plurality of mesh points of the gear pump corresponds to a respective sump of the sump assembly.

According to yet another aspect, the drive unit includes a first sump and a second sump of the sump assembly that correspond to a first mesh point of the gear pump and a second mesh point of the gear pump, respectively.

According to yet another aspect, the drive shaft extends through and operationally engages an inner gear of the generated rotor for the delivery pump element and the drive gear of the gear pump for the return pump element.

According to yet another aspect, the delivery portion of the housing and the return portion of the housing each define a sleeve that surrounds separate portions of the drive shaft and promotes delivery of the fluid along the drive shaft.

According to yet another aspect, the delivery portion includes a pump body that contains the delivery pump element, wherein the pump body includes a pressure side port that is positioned proximate a high-pressure side of the delivery pump element for delivering the fluid toward the drive shaft.

According to yet another aspect, during the operation of the drive shaft, the delivery pump element delivers the fluid from the pressure side port and along the spline of the drive shaft for lubricating at least the delivery pump element and the return pump element.

According to yet another aspect, the motor portion of the housing includes a heat rejecting mechanism that directs the heat from the printed circuit board to an area outside of the housing.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A fluid pump comprising:

a housing having a motor portion, a delivery portion and a return portion;

a motor disposed within the motor portion, the motor operably coupled to a drive shaft that extends from the motor and through the delivery portion and the return portion;

a delivery pump element disposed within the delivery portion and coupled with the drive shaft; and a return pump element disposed within the return portion of the housing and coupled with the drive shaft, wherein operation of the motor operates the delivery pump element and the return pump element via the drive shaft, wherein the delivery pump element is configured to deliver fluid from a reservoir to a drive unit, and wherein the return pump element is configured to deliver the fluid from a sump assembly of the drive unit to the reservoir; the drive shaft having a spline, and during the operation of the motor, the spline delivers a portion of the fluid into the motor portion and at least around a rotor of the motor to absorb heat from the motor and from a printed circuit board that is positioned in communication with the motor portion.

2. The fluid pump of claim 1, wherein a portion of the fluid is delivered from the delivery pump element and along the spline of the drive shaft for lubricating the delivery pump element and the return pump element.

3. The fluid pump of claim 1, wherein the operation of the motor simultaneously operates the delivery pump element and the return pump element to deliver the fluid between the reservoir, the drive unit and the sump assembly.

4. The fluid pump of claim 1, wherein the delivery pump element is a generated rotor, and wherein the return pump element is a gear pump that includes a drive gear that meshes with at least one idler gear.

5. The fluid pump of claim 4, wherein the drive shaft extends through and operationally engages an inner gear of the generated rotor for the delivery pump element and the drive gear of the gear pump for the return pump element.

6. The fluid pump of claim 1, wherein the delivery portion of the housing and the return portion of the housing each define a sleeve that surrounds separate portions of the drive shaft and promotes delivery of the fluid along the drive shaft.

7. The fluid pump of claim 1, wherein the delivery portion includes a pump body that contains the delivery pump element, wherein the pump body includes a pressure side port that is positioned proximate a high-pressure side of the delivery pump element for delivering the fluid toward the drive shaft.

8. The fluid pump of claim 7, wherein during the operation of the drive shaft, the delivery pump element delivers the fluid from the pressure side port and along the spline of the drive shaft for lubricating at least the delivery pump element and the return pump element.

9. The fluid pump of claim 1, wherein the motor portion of the housing includes a heat rejecting mechanism that directs heat from a printed circuit board to an area outside of the housing.

10. The fluid pump of claim 4, wherein the gear pump includes a dedicated mesh point that places the return pump element in communication with a respective sump of the sump assembly, wherein the dedicated mesh point corresponds to the respective sump.

11. A fluid pump comprising:

a housing;

a motor disposed within a motor portion of the housing;

a delivery pump element disposed within a delivery portion of the housing; and a return pump element disposed within a return portion of the housing, wherein a drive shaft is coupled to each of the delivery pump element and the return pump element, and wherein operation of the motor contemporaneously operates the delivery pump element and the return pump element via the drive shaft, wherein the delivery pump element is configured to deliver fluid from a reservoir to a drive unit, and wherein the return pump element is configured to deliver the fluid from a sump assembly of the drive unit to the reservoir; the drive shaft having a spline, and during the operation of the motor, the spline delivers a portion of the fluid into the motor portion and at least around a rotor of the motor to absorb heat from the motor and from a printed circuit board that is positioned in communication with the motor portion.

12. The fluid pump of claim 11, wherein a portion of the fluid is delivered from the delivery pump element and along the spline of the drive shaft for lubricating the delivery pump element and the return pump element.

13. The fluid pump of claim 11, wherein the return pump element is a gear pump that includes a drive gear that meshes with a pair of idler gears to define a plurality of mesh points, each mesh point of the plurality of mesh points configured to generate a suction to draw the fluid from the sump assembly to the return pump element, wherein each mesh point of the plurality of mesh points of the gear pump corresponds to a respective sump of the sump assembly.

14. The fluid pump of claim 13, wherein the drive shaft extends through and operationally engages an inner gear of a generated rotor for the delivery pump element and the drive gear of the gear pump for the return pump element.

15. The fluid pump of claim 12, wherein the delivery portion includes a pump body that contains the delivery pump element, wherein the pump body includes a pressure side port that is positioned proximate a high-pressure side of the delivery pump element for delivering the fluid toward the drive shaft.

16. A fluid pump comprising:

a housing;

a motor disposed within a motor portion of the housing;

a delivery pump element disposed within a delivery portion of the housing;

a return pump element disposed within a return portion of the housing;

a drive shaft having a spline, the drive shaft extending from a rotor of the motor and to each of the delivery pump element and the return pump element, wherein operation of the motor contemporaneously operates the delivery pump element and the return pump element via the drive shaft;

the delivery pump element is configured to deliver fluid from a reservoir to a drive unit;

the return pump element is configured to deliver the fluid from a sump assembly of the drive unit to the reservoir; and during the operation of the motor, the spline delivers a portion of the fluid into the motor portion and at least around the rotor of the motor to absorb heat from the motor and from a printed circuit board that is positioned in communication with the motor portion.

17. The fluid pump of claim 16, wherein the operation of the delivery pump element delivers the portion of the fluid and the collected heat away from the motor portion and through the delivery portion of the housing, and wherein the spline also delivers the portion of the fluid for lubricating the delivery pump element and the return pump element.

18. The fluid pump of claim 16, wherein the delivery pump element is a generated rotor, wherein the return pump element is a gear pump that includes a drive gear that meshes with at least one idler gear, and wherein the drive shaft extends through and operationally engages an inner gear of the generated rotor for the delivery pump element and the drive gear of the gear pump for the return pump element.

19. The fluid pump of claim 18, wherein the gear pump includes a plurality of mesh points, each mesh point of the plurality of mesh points configured to generate a suction to draw the fluid from the sump assembly to the return pump element, wherein each mesh point of the plurality of mesh points of the gear pump corresponds to a respective sump of the sump assembly.

* * * * *